United States Patent [19]

Julian

[11] Patent Number: 4,919,374

[45] Date of Patent: Apr. 24, 1990

[54] PLASTIC LINER SECURING APPARATUS

[75] Inventor: Marland R. Julian, Baker, Oreg.

[73] Assignee: J - MARK Industries, Baker, Oreg.

[21] Appl. No.: 164,884

[22] Filed: Mar. 7, 1988

Related U.S. Application Data

[63] Continuation-in-part of Ser. No. 103,902, Oct. 2, 1987, abandoned, which is a continuation-in-part of Ser. No. 39,384, Apr. 17, 1987, abandoned.

[51] Int. Cl.[5] ..... B65B 7/12

[52] U.S. Cl. ..... 248/95; 24/68 B; 24/71.2; 24/269; 220/1 T; 220/404

[58] Field of Search ..... 248/95, 97, 99, 100; 24/269, 71.2, 68 R, 68 B; 220/403, 404, 1 T; 5/498

[56] References Cited

U.S. PATENT DOCUMENTS

| | | | |
|---|---|---|---|
| 1,432,486 | 10/1922 | Morris | 248/97 |
| 1,467,943 | 9/1923 | Lampert | 24/71.2 |
| 2,501,214 | 3/1950 | Duket | 24/68 R |
| 2,604,098 | 7/1952 | Kranc | 24/269 X |
| 3,633,857 | 1/1972 | Logan | 24/269 |
| 3,754,785 | 8/1973 | Anderson | 248/99 X |
| 3,814,359 | 6/1974 | Powell | 248/95 X |
| 3,962,759 | 6/1976 | Nagai | 24/269 |
| 4,027,774 | 6/1977 | Cote | 248/99 X |
| 4,267,996 | 5/1981 | Turcott | 248/97 |
| 4,338,979 | 7/1982 | Dow | 248/97 X |
| 4,418,833 | 12/1983 | Watts | 248/100 X |
| 4,535,911 | 8/1985 | Goulter | 220/404 |

*Primary Examiner*—David L. Talbott

[57] ABSTRACT

A process and a device for holding a flexible plastic liner within a rigid or semi-rigid waste or storage container.

The device or apparatus includes a split or divided shaft 30 which is attached to a ratchet wheel 104, which is controlled by a worm gear 102. Worm gear 102 is capable of moving the ratchet wheel both forwards and backwards and holding the wheel stationary. The worm gear is attached to or is a formed part of the shaft 111 which is further attached to a key or handle 100, that when rotated, turns the shaft 111, the ratchet wheel 104, and the split or divided shaft 30. The worm gear 102, the shaft 111, and the ratchet wheel 104 are housed in a split housing with top part 98 and bottom part 99. The housing 98-99, contains an attachment strap holder 46 through which the attachment strap 44 passes, thereby, attaching the device to the attachment strap 44. The attachment strap 44 is further hooked over the top edge 110 of the container 108, thereby, attaching the device to the container. The process involves placing the flexible plastic liner 112 within the container 108, folding its top uppermost portion 114 over the container edge 110, inserting the folded over liner portion 114 into the split or divided shaft 30 and rotating shaft 30 until the liner portion 114 is securely tightened around the top portion of the container 108.

7 Claims, 22 Drawing Sheets

PRIOR ART

PLASTIC LINER SECURING APPARATUS

This application is a continuation-in-part of Ser. No. 07/103,902 filed 10/02/87, now abandoned, which is a continuation-in- part of Ser. No. 07/039,384 filed 04/17/87, now abandoned.

BACKGROUND

1. FIELD OF INVENTION

This invention relates to a plastic or metal tension device, in particular, a tension device for securing flexible plastic liners within waste or storage containers, thereby preventing said liners from being displaced from said containers when said containers are filled or are being filled.

2. DESCRIPTION OF PRIOR ART

In the past, flexible plastic liners have been placed in waste or storage containers for easy and sanitary disposal of waste or for the storage of commodities. Support for the liner has been obtained by providing it with extra length to enable its top to be folded down over the top and part way down the outside of the container. One of the problems with this arrangement is that as the liner is filled or being filled, it tends to slip down from the top of the container so that it must be re-suspended or re-positioned from time to time. Another problem is the serious and useless waste of plastic liner material needed to hold the liner in position.

OBJECTS AND ADVANTAGES

Accordingly one object and advantage of the present invention is to provide a means for easily attaching flexible plastic liners to waste or storage containers so as to prevent said liners from slipping into said containers when said containers are being filled. Other objects and advantages are to provide such a means which is simple in design, easily mountable, holds the top of the bag open for easy deposit of waste or commodities, enables such liners to hang down inside the container for complete filling, enables such liners to be reused and not thrown away, is simple to manufacture and package. A significant reduction in the amount of plastic material used in the manufacture of plastic liners will result by using this invention. Further object and advantages of the invention will become appatent from a consideration of the drawings and ensuing description thereof.

DRAWING REFERENCE NUMERALS

Figure 4:
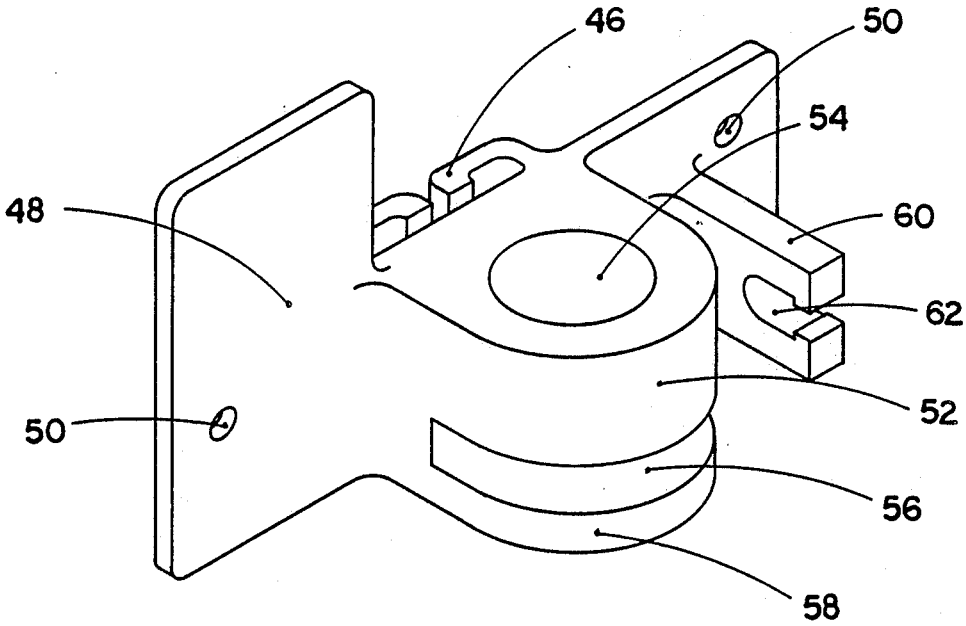
FIG. 4 is a prespective view of the main housing, mounting bracket, ratchet handle holder, and support attachment strap holder.
Figure 8:
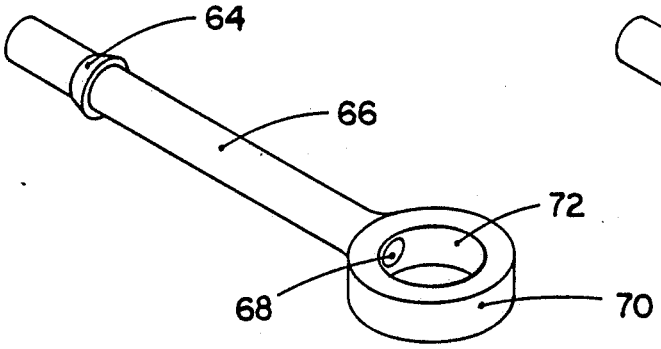
FIG. 8 is a prespective view of the lower ratchet handle and ratchet wheel encloser.
Figure 13:
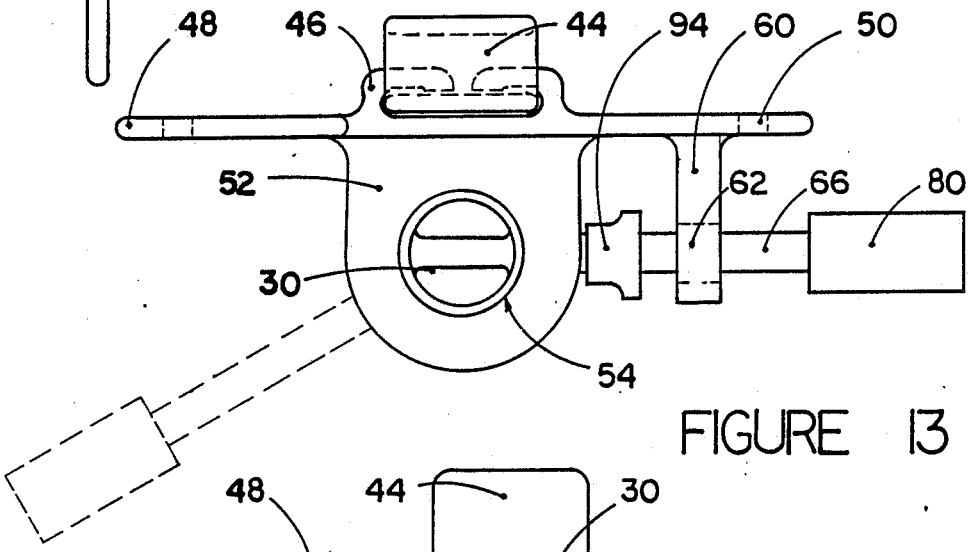
FIG. 13 is a prespective top view of the plastic liner securing apparatus of the present invention.
Figure 16:
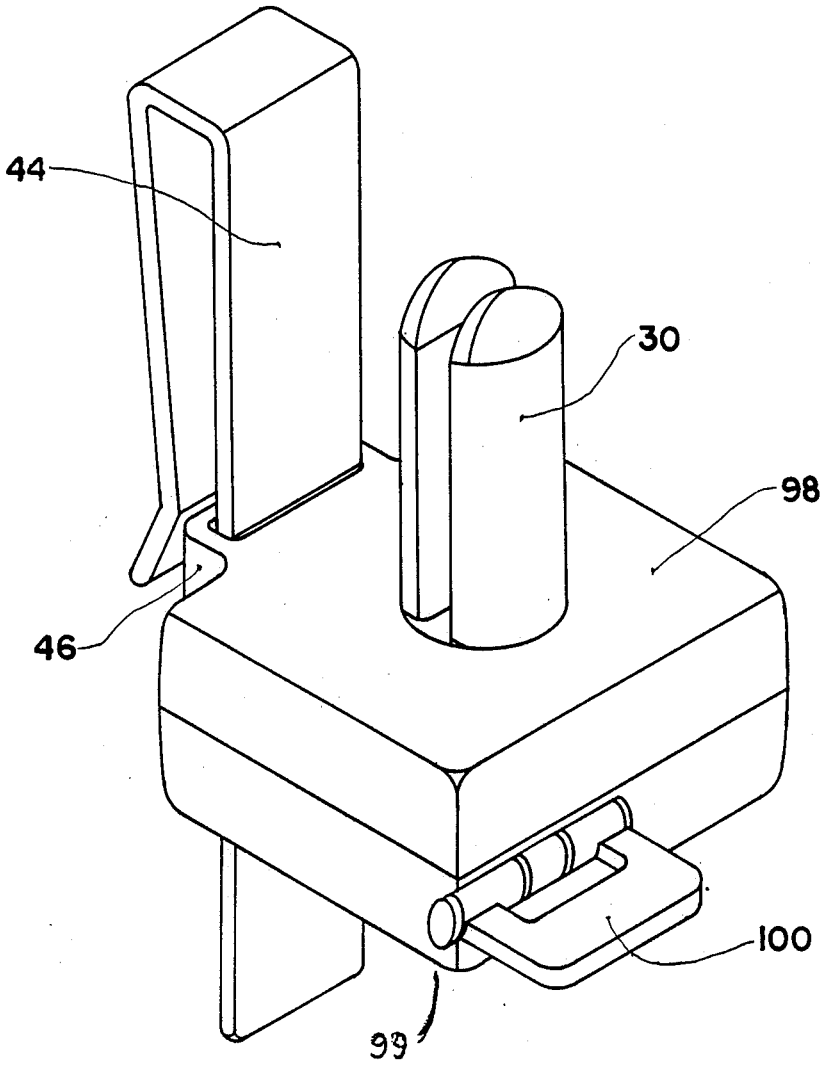
FIG. 16 is a prespective view of another form or embodiment of the plastic liner securing apparatus of the present invention.
Figure 17:
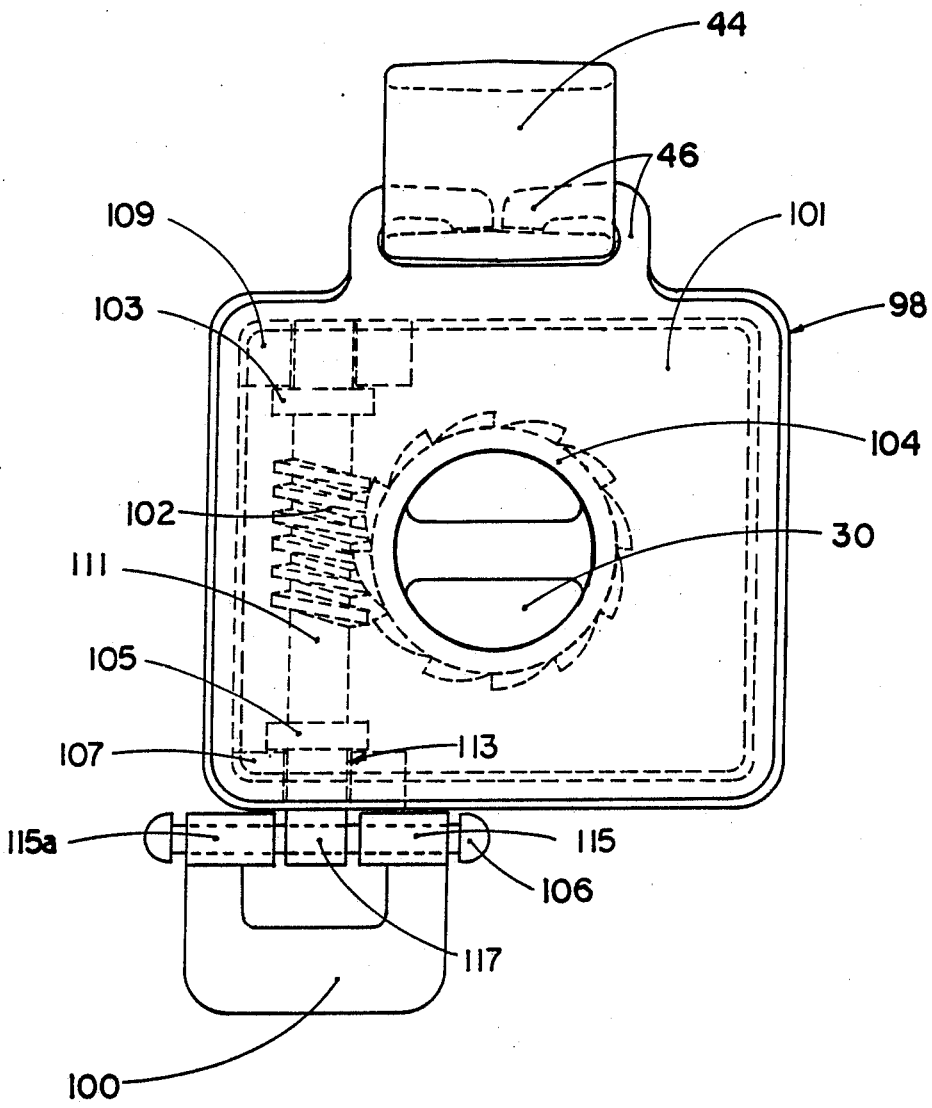
FIG. 17 is a prespective top view of a worm gear controlled ratchet wheel or worm gear controlled split or divided shaft.
Figure 18:
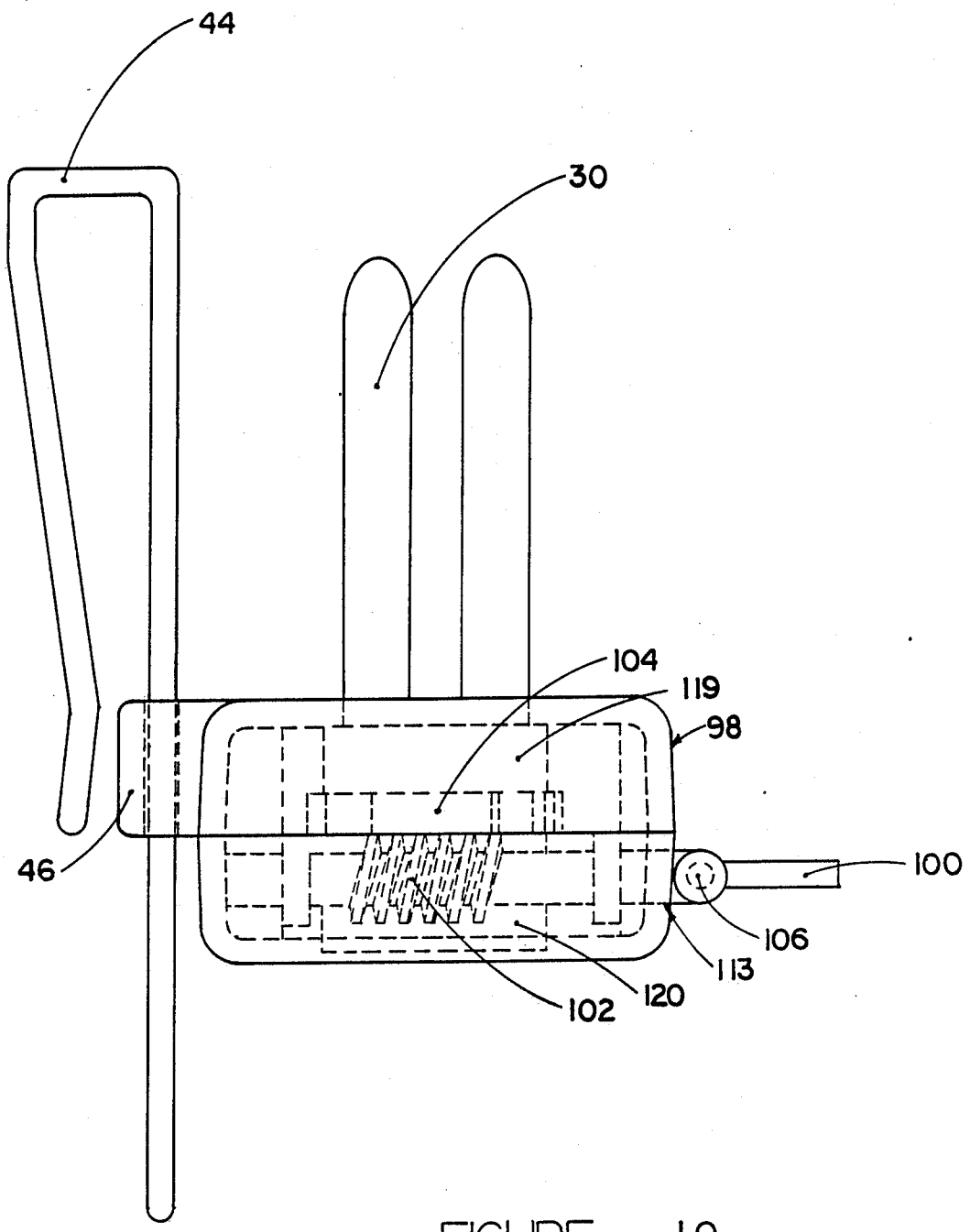
FIG. 18 is a prespective side view of FIG. 16.
Figure 23:
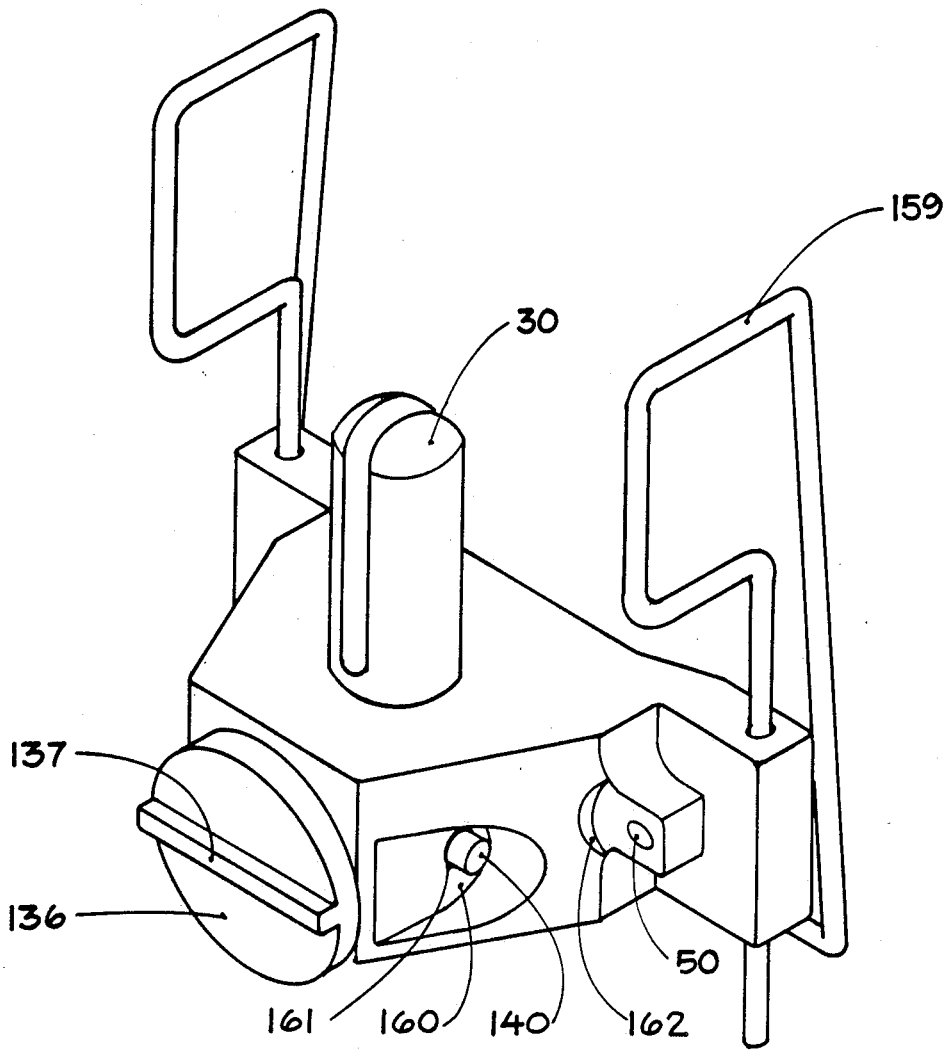
FIG. 23 is a prespective view of another embodiment showing a twist knob and hanger attachment.
Figure 25:
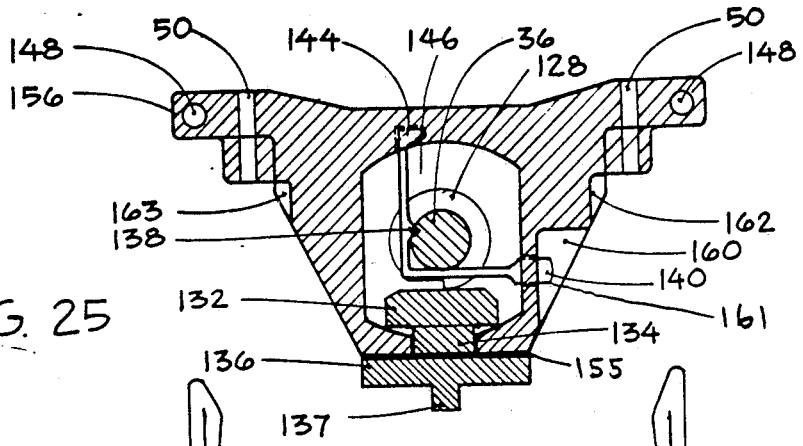
FIG. 25 is a sectional top view of FIG. 23.
Figure 27:
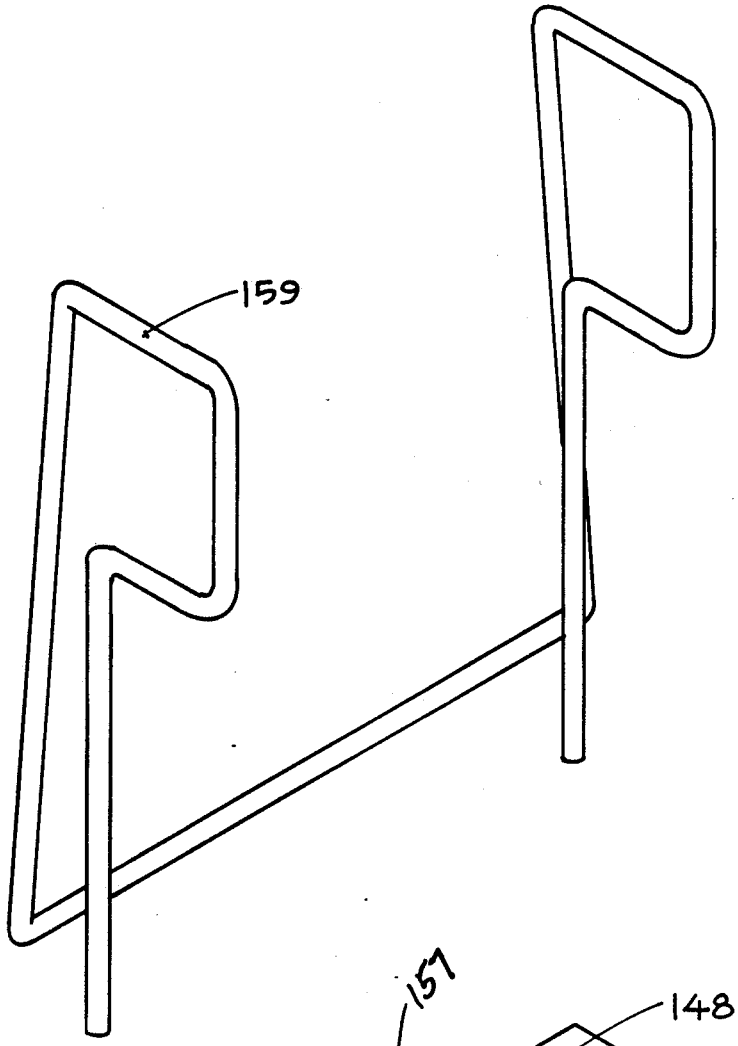
FIG. 27 is a prespective view of the hanger of FIG. 23.
Figure 28:
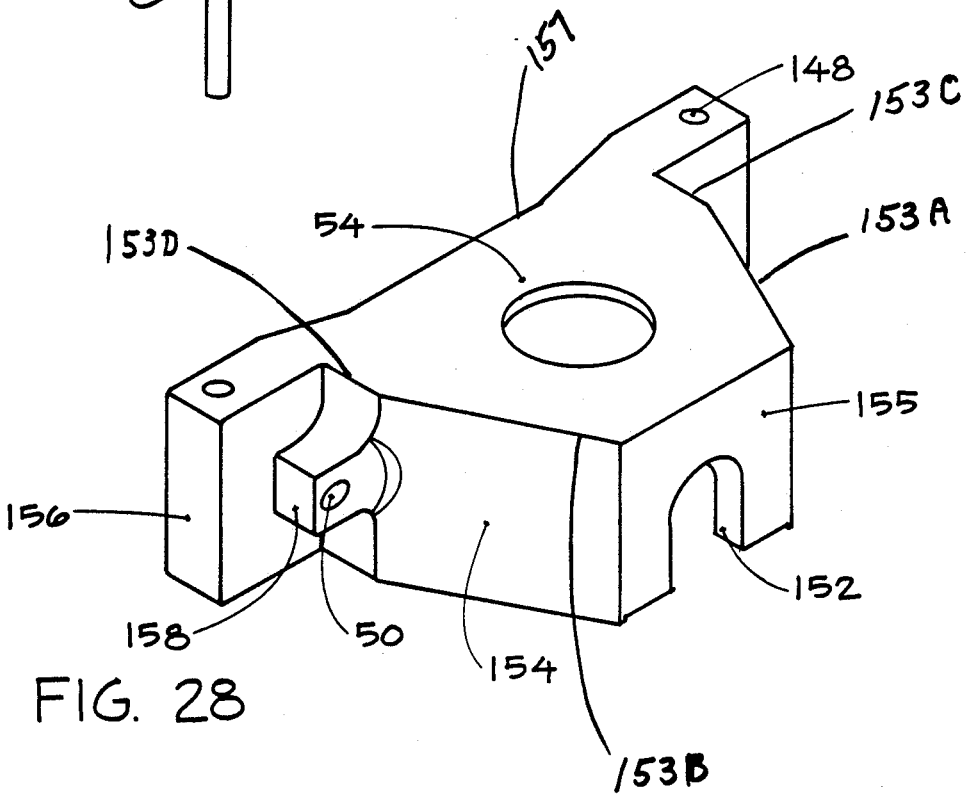
FIG. 28 is a prespective view of the housing body in FIG. 23.
Figure 29:
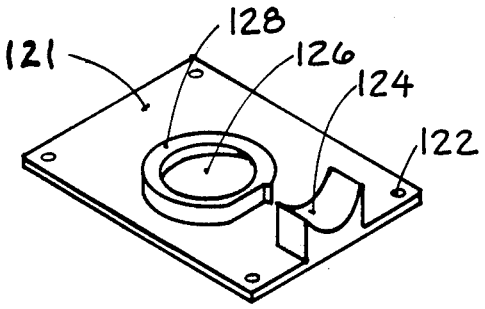
FIG. 29 is a prespective view of the bottom securing plate of FIG. 23.
Figure 30:
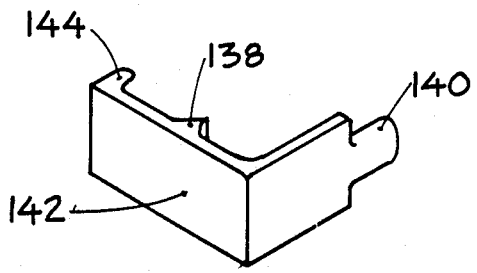
FIG. 30 is a prespective view of the pawl of FIG. 30.
Figure 31:
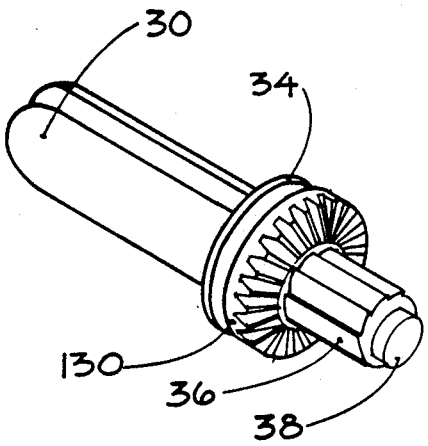
FIG. 31 is a prespective view of the split or divided accumulator of FIG. 23.
Figure 32:
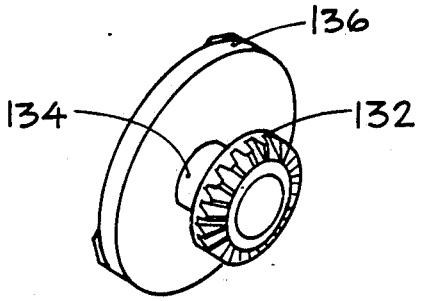
FIG. 32 is a prespective view of the twist knob and beveled drive gear in FIG. 23.

30 split or divided accumulator
32 main ratchet wheel
33 shaft spacer
34 snap ring retainer
36 pawl ratchet wheel or gear
38 shaft end portion
40 hexagon nut
44 support attachment strap
46 attachment strap holder
48 mounting bracket
50 holes in mounting bracket
52 top housing portion in FIG. 4
53 cavity in housing portion 52 in FIG. 13
54 hole in top housing portion in FIG. 4
56 slot in housing portion in FIG. 4
58 bottom housing portion in FIG. 4
60 arm snap retainer in FIG. 4
62 interior opening in the arm snap retainer in FIG. 4
64 spring retainer snap ring
66 exterior portion of the lower ratchet arm assembly in FIG. 8
68 open end hole and interior portion of the lower ratchet arm
70 exterior portion of the main body, lower ratchet arm
72 interior portion of the main body, lower ratchet arm
74 round portion of the hexagon wrench handle
76 cut away portion of the hexagon wrench handle
78 hexagon wrench body portion of the hexagon wrench
80 push knob of the upper ratchet arm assembly
82 main ratchet arm
84 spring in push knob 80
86 pawl spring retainer
88 ratchet arm shaft
90 ratchet arm spring
92 snap knob retainer
93 pawl pull knob cavity
94 pawl pull knob body
96 hole in pull knob
98 top housing portion in FIG. 16
99 bottom housing portion in FIG. 16
100 key handle in FIG. 16
101 interior portion of housing in FIG. 17
102 worm gear
103 shaft bushing
104 main ratchet wheel in FIG. 17
105 shaft bushing
106 securing pin in FIG. 17
107 support block in FIG. 17
108 rigid or semi-rigid waste or storage container
109 support block in FIG. 17
110 rim or edge of the waste or storage container
111 main worm gear shaft in FIG. 17
112 inserted portion of the flexible plastic liner
113 hole in support block 107 and housing portion 99 in FIG. 17
114 rolled down or folded over portion of the inserted liner
115 hole in right key base portion
**115*a*** hole in left key base portion
116 accumulated liner portion
117 hole in shaft end in FIG. 17
120 shaft end in FIG. 18
121 bottom securing plate in FIG. 29
122 weld holes in bottom securing plate in FIG. 29
124 shaft support for shaft 134 FIG. 29
126 recessed portion of shaft end support
128 raised portion surrounding recessed portion 126
130 main beveled gear in FIG. 31
132 drive beveled gear in FIG. 31
134 shaft connecting drive beveled gear to twist knob FIG. 32
135 recessed portion of main housing which receives part 34 of FIG. 31
136 twist knob in FIG. 25
137 raised portion of the twist knob in FIG. 23
138 gear engageing portion of the pawl in FIG. 30
140 push button end of pawl in FIG. 30
142 pawl in FIG. 30
144 end of the pawl which is inserted into the housing in FIG. 25
146 cavity in the housing body 154 in FIG. 25
148 holes through which hanger 159 is inserted in FIG. 25
152 cut out portion of housing portion 155 which fits over shaft 134 in FIG. 28
153 top view portion of the main housing 154 in FIG. 28
153A the right side face of the housing 154 in FIG. 28
153B the left side face of the housing 154 in FIG. 28
153C the back right side face of the housing 154 in FIG. 28
153D the back left side face of the housing 154 in FIG. 28
154 the main housing in FIG. 28
156 the end portion of the mounting bracket portion of the main housing portion in FIG. 28
157 recessed portion in the mounting bracket portion of the housing 154.
158 raised attachment portion of the mounting bracket portion of the housing portion in FIG. 28.
159 attachment hanger in FIG. 27
160 recessed portion of the main housing 154 containing the pawl push end in FIG. 23.
161 hole through which pawl end 140 passes in FIG. 23
162 recessed portion of part 158 which allows easy attachment of nuts.
163 recessed portion of part 158 which allows easy attachment of nuts.

DETAILED DESCRIPTION OF THE PREFERRED EMBODIMENT

Figure 1:
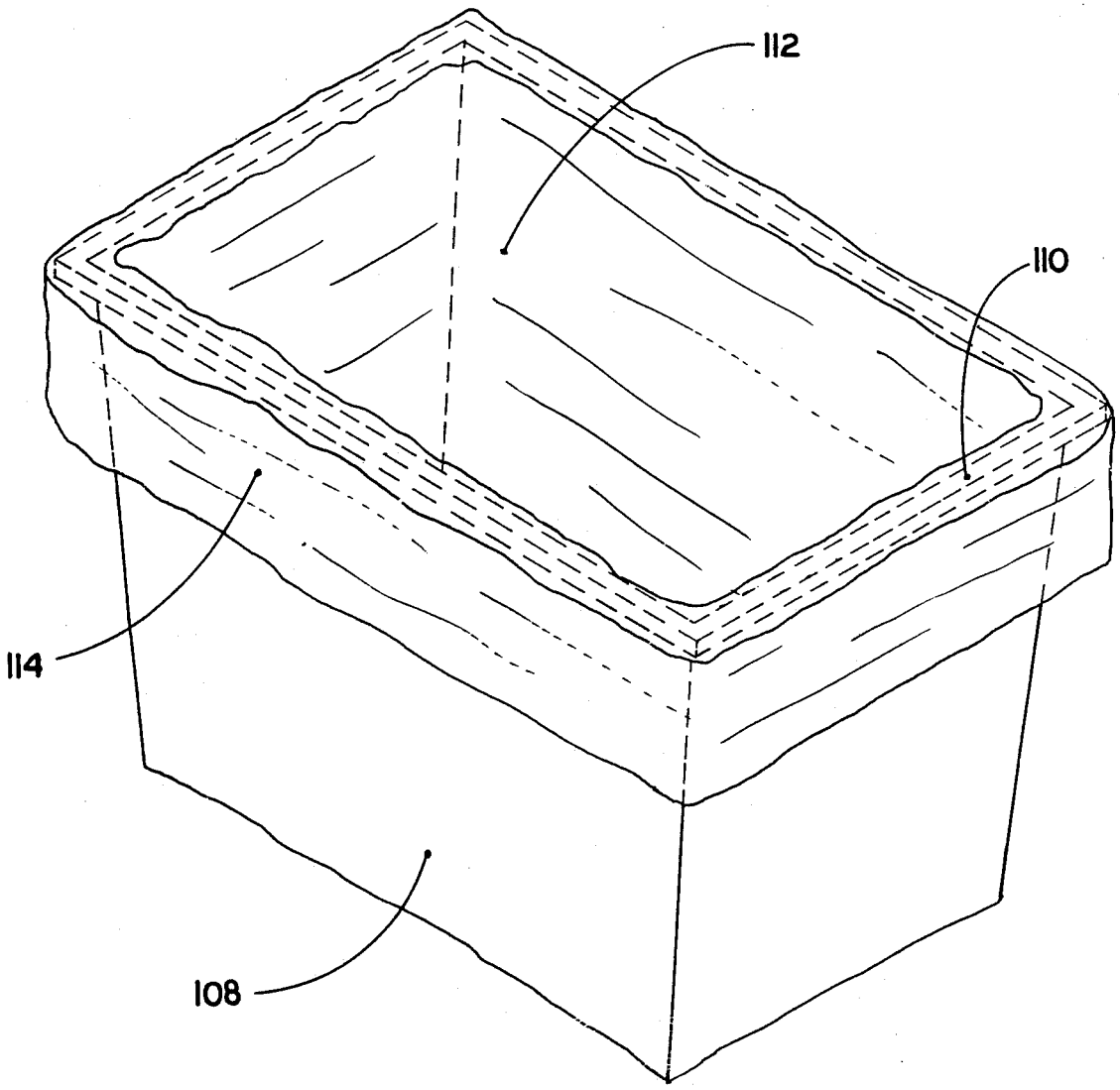
FIG. 1 is a prespective view of a prior art plastic liner placed in a waste or storage container.

FIG. 1 shows a prior art waste or storage container 108 with a rim or edge 110, and further showing a flexible plastic liner with its lower portion 112 inserted within said container 108, and with its top uppermost portion 114 being rolled or folded over edge 110, thereby, extending down the exterior sides of the container 108.

As stated, this arrangement is fraught with disadvantages, namely, the folded down or rolled over portion 114 tends to slip down into the container 108 and must be repositioned as the liner 112 is being filled. Furthermore, the liner 112 is difficult to empty without removing the liner 112 from the container 108. Furthermore, larger liners than necessary are being used in an attempt to prevent the liners from slipping into the containers, thereby, wasting a great amount of plastic liner material each time this method is used.

Figure 2:
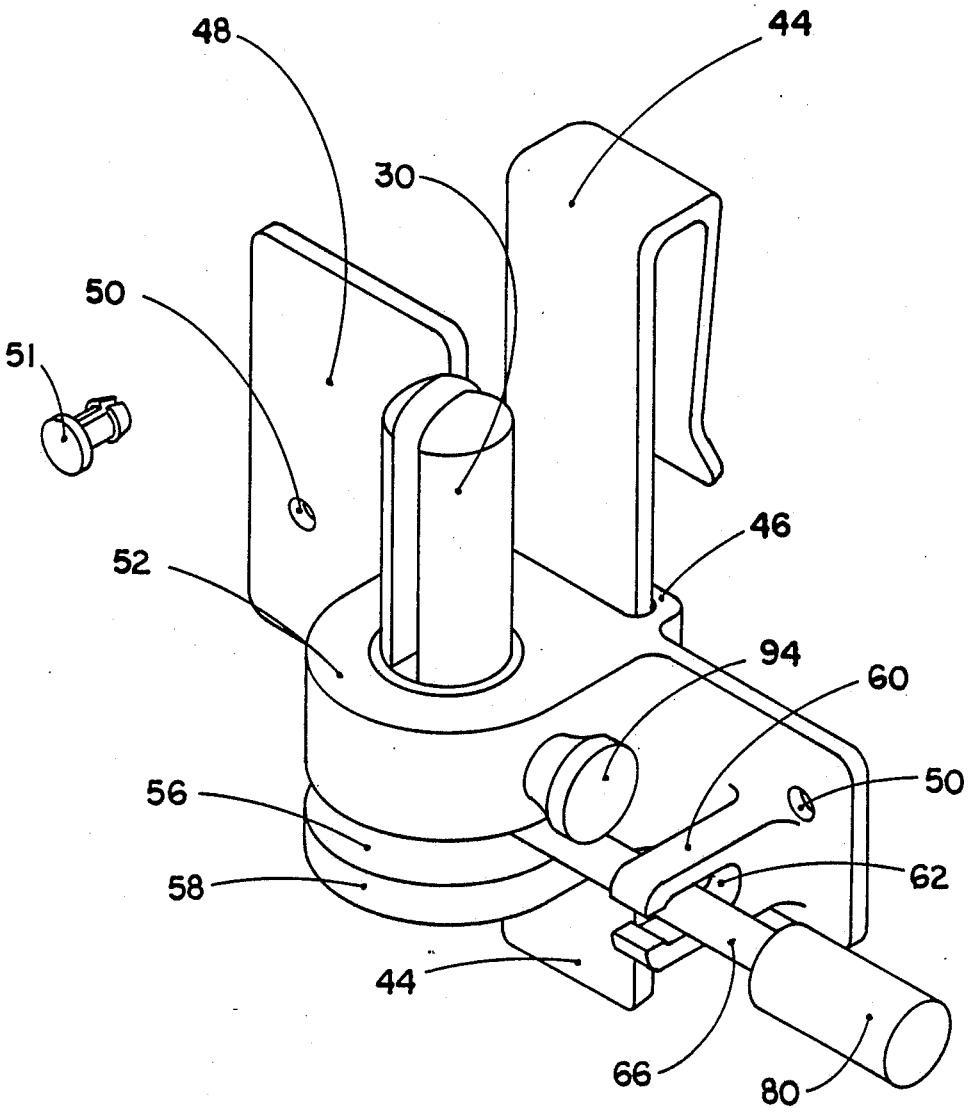
FIG. 2 is a prespective view of the plastic liner securing apparatus of the present invention.

FIG. 2 shows the plastic liner securing apparatus with the support attachment strap 44, positioned within the strap holder 46, which is part of the main housing 52. Furthermore, FIG. 2 shows the mounting bracket 48 which is also part of the main housing 52. The mounting bracket 48 contains two identical holes, both numbered 50, which are used for attaching said bracket to the waste or storage container 108, with bolts or plastic fasteners 51. Furthermore, FIG. 2 shows a split or divided accumulator 30 which is used as the holder and accumulator of the inserted plastic liner portion 114 of FIG. 1. Furthermore, FIG. 2 shows the ratchet arm 66 within slot 56, which is between the top housing portion 52 and the bottom housing portion 58. Furthermore, FIG. 2 shows the ratchet arm 66 with the push knob end 80 resting within the opening 62 of the arm snap retainer 60. Furthermore, FIG. 2 shows the ratchet pull knob 94 attached to the top housing portion 52.

Figure 3:
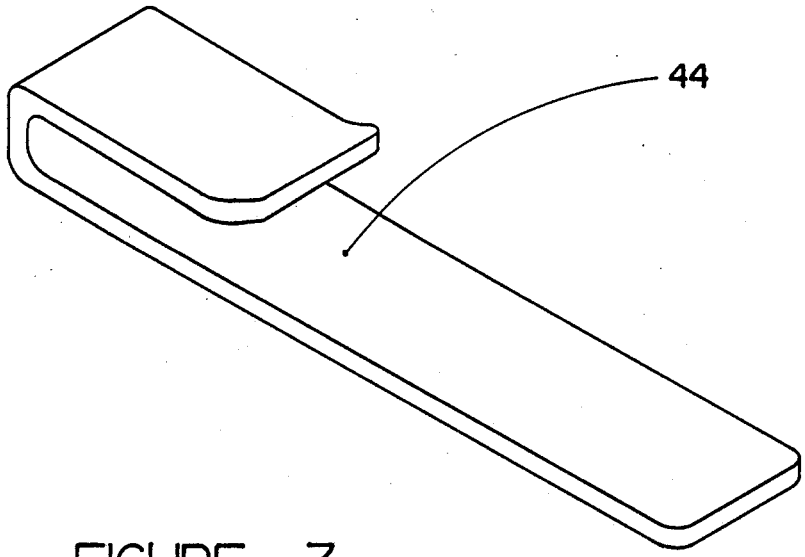
FIG. 3 is a prespective view of the support attachment strap.

FIG. 3 shows the plastic liner securing apparatus support attachment strap 44, which is a u-shaped strap having a long side measuring approximately four and one half inches by one inch wide, a u portion approximately one inch by one inch, and a short side approximately two and one half inches long by one inch wide. The long side fits on the exterior side of the container 108, passing through the support strap holder 46, thereby, allowing the plastic liner securing apparatus to be attached to the container 108 in FIG. 1, when the u portion of the u-shaped attachment strap is placed over the edge 110 and the short leg of the strap is placed on the inside of the container 108. The thickness of the support attachment strap 44 is one eight inch and may be made of metal or plastic.

FIG. 4 shows the main housing 52-54-58, as formed into the mounting bracket 48, said bracket measures approximately three and one half inches wide, two and one half inches high on its left or high side and one and one fourth inches high on its right or low side. FIG. 4 further shows two holes, both numbered 50, placed on center, one positioned approximately three eights inches from the left side of the bracket, and three fourths inches from the bottom of the bracket, and the other positioned approximately three eights inches from the right side of the bracket and approximately three fourths inches from the bottom of the bracket. Not shown, the mounting brackets high side and low side portions are manufactured of a plastic or metal material capable of being bent or curved to fit round containers.

Figure 5:
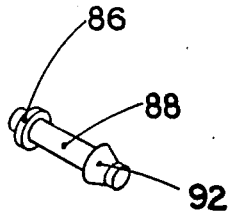
FIG. 5 is a prespective view of the ratchet pawl shaft.

FIG. 5 shows parts 86-88-92, which make up the ratchet pawl arm, with the main shaft being 88, the spring retainer being 86 which is attached to the main shaft 88, and the snap retainer being 92 which is also attached to the main shaft 88 and which fits into the hole 96 of the pull knob 94 and secures the said knob to the shaft 88. The spring retainer 86 keeps the pawl spring 90 between the said spring retainer and the interior portion of the main housing portion 52, thereby, applying pressure to the ratchet pawl arm when the arm is in contact with the pawl ratchet wheel.

Figure 6:
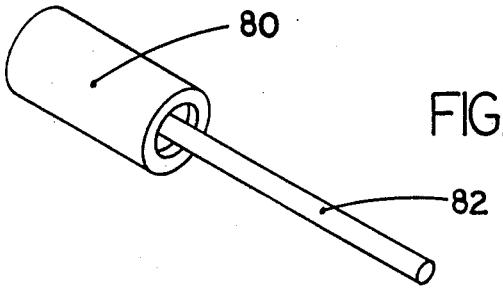
FIG. 6 is a prespective of the upper ratchet handle and internal ratchet shaft.
Figure 10:
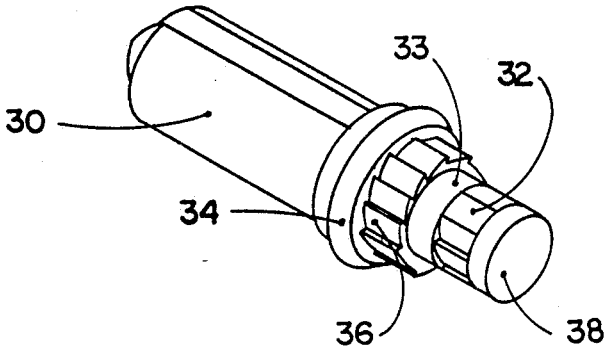
FIG. 10 is a prespective view of the main split or divided shaft, the main ratchet wheel, and the pawl ratchet wheel.

FIG. 6 shows the upper ratchet arm assembly 80-82, with 80 being the push knob and 82 being the main ratchet arm which engages the main ratchet wheel 32 of FIG. 10.

Figure 7:
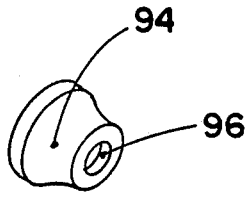
FIG. 7 is a prespective view of the ratchet pawl handle.

FIG. 7 shows the pawl ratchet arm knob 94 with the end hole 96 which fits over the snap retainer 92 of FIG. 5, thereby, attaching the knob 94 to the ratchet pawl arm 88 of FIG. 5.

FIG. 8 shows the lower ratchet arm 64-66-68-70-72, with 64 being the push knob snap retainer for the push knob 80 of the upper ratchet arm assembly of FIG. 6. FIG. 8 further shows the exterior portion 66 of the lower ratchet arm assembly which houses or contains the main ratchet arm 82 of the upper ratchet arm assembly 80–82 of FIG. 6. FIG. 8 further shows the main body of the lower ratchet arm assembly exterior part 70, interior part 72, which encircles and encloses the main ratchet wheel 32 of FIG. 10. FIG. 8 further shows the open end 68 of the hollow lower ratchet arm assembly which encases the main ratchet arm 82 of FIG. 6.

Figure 9:
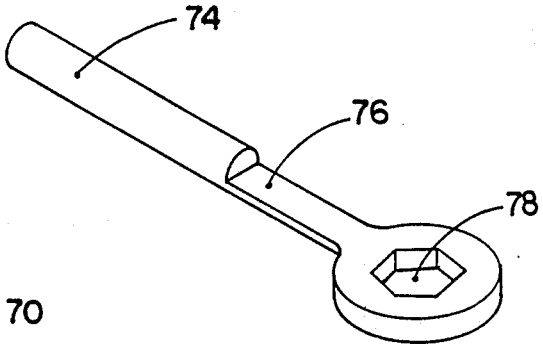
FIG. 9 is a prespective view of a hexagon wrench used to turn the hexagon nut in FIG. 11.

FIG. 9 shows another embodiment, being a hexagon wrench 74-76-78, with 74 being the round handle portion, 76 being the cut away portion which is attached to the main wrench body. FIG. 9 further shows the hexagon wrech 78 which fits over the hexagon nut 40 of FIG. 11.

FIG. 10 shows the main split or divided accumulator 30, the snap retainer 34 which holds the said accumulator vertical and perpendicular to the top surface of the main housing 52 of FIG. 2, and holds the parts 32-33-36, and 38 within the interior body of the main housing 52 of FIG. 2. FIG. 10 further shows the the pawl ratchet wheel 36, the accumulator spacer 33, and the main ratchet wheel 32 connected to the accumulator end 38 which fits into the recessed interior portion of the main housing casting 58 of FIG. 2.

Figure 11:
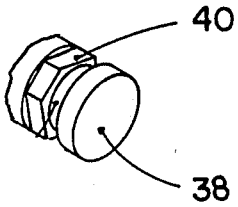
FIG. 11 is a prespective view of a hexagon nut replaceing the main ratchet wheel in FIG. 10.

FIG. 11 shows another embodiment of FIG. 10, with a hexagon nut 40 replacing the main ratchet wheel 32 of FIG. 10 and is rotated by the hexagon wrench 78 of FIG. 9.

Figure 12:
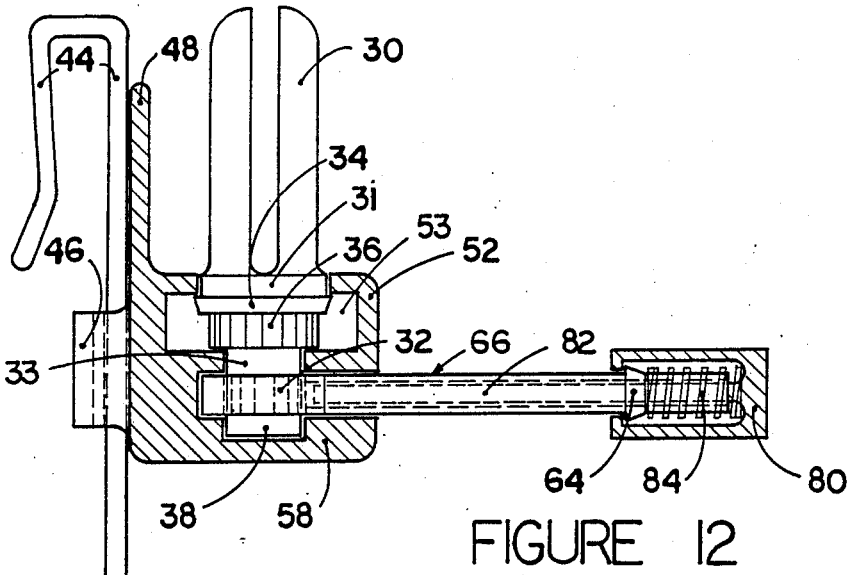
FIG. 12 is a sectional view of the plastic liner securing apparatus of the present invention.

FIG. 12 shows a sectional view of the plastic liner securing apparatus, showing the hollow core 53 of the main housing 52. FIG. 12 further shows the split or divided accumulator 30 with two vertical portions each approximately one and three fourths inches in length, being rounded on top, and being formed into a common base 33 which is approximately seven eights inches in diameter and three sixteenths inches thick and is further attached to the snap retainer 34 which is approximately three thirty seconds inches thick and fifteen sixteenths inches in diameter. FIG. 12 further shows the snap retainer 34 being attached to the pawl ratchet wheel 36 which is approximately three fourths inches in diameter and one fourth inch thick, the pawl ratchet wheel has approximatelt sixteen equal and identical sized teeth. FIG. 12 further shows the shaft spacer 33 which is approximately one half inch in diameter and is approximately three sixteenths inches thick. FIG. 12 further shows the main ratchet wheel 32 attached to the bottom of the shaft spacer 33 and is approximately one half inch in diameter and one fourth inch thick. The main ratchet wheel has approximately 12 equal and identical sized teeth. FIG. 12 further shows the shaft end part 38 which fits into the hollow or recessed portion 53 of the bottom portion 58 of the housing casting. NOTE: the vertical portions of accumulator 30 are approximately one fourth inch thick at their center, have the same arc as their base and are slightly rounded on their exposed edges to prevent the edges from tearing the inserted liner portion 114. FIG. 12 further shows that accumulator end 38 holds parts 32-33, and 36 in a vertical position whenever the split or divid accumulator 30 is in a vertical position. FIG. 12 further shows the main ratchet arm 66 within slot 56 of the main housing. FIG. 12 further shows the hollow portion of the knob 80 containing the spring retainer snap ring 64 which is molded into or is otherwise attached to the main ratchet shaft 66. FIG. 12 further shows the spring 84 between the spring retainer snap ring 64 and the upper end of the push knob 80, which keeps the ratchet arm 82 from engageing the main ratchet wheel 32 until the push knob 80 is depressed. Furthermore, FIG. 12 shows the ratchet arm spring 84 which is approximately five eights inches in lenth and is approximately five sixteenths inches in diameter and is of sufficent strength to prevent the ratchet arm 82 from engageing the main ratchet wheel 32 when the push knob 80 is in an extended position. FIG. 12 further shows the ratchet arm 82 which is approximately two and three fourths inches in length and one eight inch in diameter and is attached to the interior center portion of the push knob 80 of the upper ratchet arm assembly. The push knob 80 is approximately one inch in length, nine sixteenths inches in diameter, and has a hollow core approximately three fourths inches in length and seven sixteenths inches in diameter with an opening approximately one fourth inch in diameter, this portion of the push knob 80 is forced over the spring retainer snap ring 64 which is approximately five sixteenths inches in diameter on the large end, approximately one eight inch thick, and approximately one fourth inch in diameter on the small end, thereby, securing the push knob 80 to the lower ratchet arm 66.

A further embodiment of FIG. 12 is the elimination of the bottom housing portion 58 in FIG. 12, the elimination of the ratchet wheel 32 in FIG. 12 and the elimination of the accumulator end 38 in FIG. 12, thereby, ending the accumulator portion 30 of FIG. 12 in the accumulator spacer 33 of FIG. 12. The accumulator spacer 33 would then be extended to approximately one inch in length and would then be further attached to or end in a round knob measuring approximately three fourths inches in diameter by one fourth inch in thickness and said knob would be used to rotate the split or divided accumulator 30 of FIG. 12.

FIG. 13 shows a prespective top view of the plastic liner securing apparatus, with the support attachment strap 44 in the strap holder 46 which is attached to or is a formed part of the mounting bracket 48, said holder is comprised of two parts each approximately nine sixteenths inches wide, one eight inch thick, and approximately three fourths inches from top to bottom. FIG. 13 further shows the parts as they extend outward from the back of the bracket 48, wrap around and curve slightly inward at their ends, thereby, forming a cavity or opening which allows for the insertion of the attachment support strap 44. FIG. 13 further shows the ratchet arm 66 within the ratchet arm holder which is comprised of two horizontal parts each approximately one-fourth inch by one-fourth inch by one half inch from front to back and with their back portions attached to a common base part which is approximately one-fourth inch wide by approximately nine-sixteenths inches from front to back and three-fourths inches from top to bottom, this common base part is attached to the mounting bracket 48 at a point approximately nine-sixteenths inches in from the right vertical side of the mounting bracket 48, and approximately one-sixteenths inch from the bottom horizontal edge of the mounting bracket 48. FIG. 13 further shows how the ratchet arm 66 will moved so as to rotate the split or divided accumulator 30.

Figure 14:
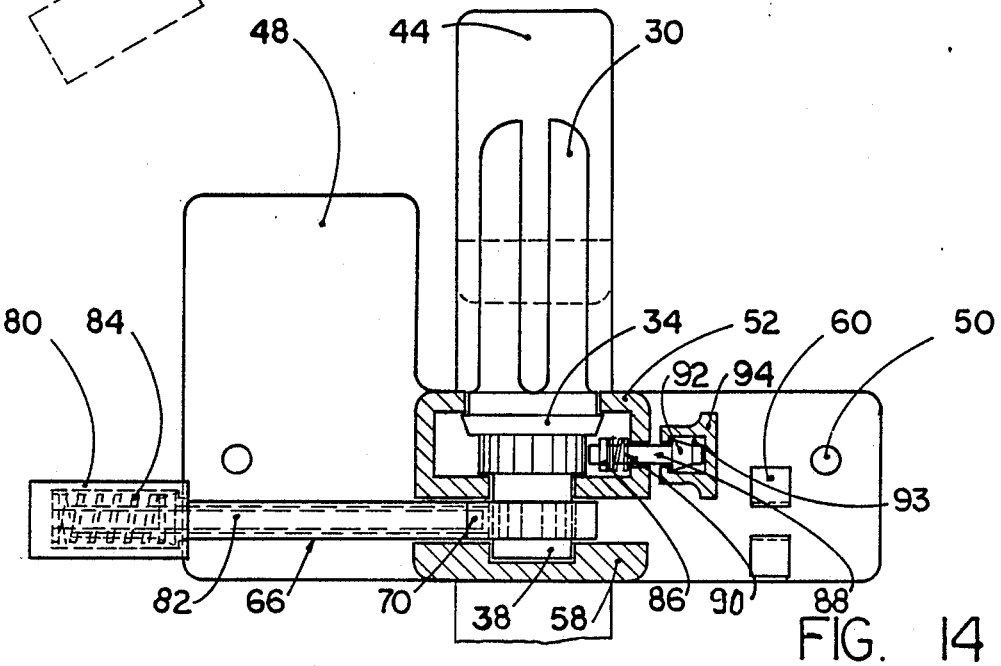
FIG. 14 is a prespective front view of the plastic liner securing apparatus of the present invention.

FIG. 14 shows the ratchet pawl arm shaft 88 as it engages the pawl ratchet wheel 36 of FIG. 12. FIG. 14 further shows the spring retainer 86 which is attached to or is a part of the ratchet pawl arm shaft 88 and is approximately three-sixteenths inches in diameter and approximately three-thirty-seconds inches thick. FIG. 14 further shows the pawl arm spring 90 which is approximately three-sixteenths inches in diameter by approximately one-eight inch in length and has the strength necessary to keep the pawl ratchet arm 88 engaged with the pawl ratchet wheel 36 of FIG. 12 allowing the pawl ratchet wheel 36 of FIG. 12 to rotate in one direction only when the pawl ratchet arm 88 is engaged, and allows the pawl ratchet arm wheel 36 of FIG. 12 to counter-rotate when the pawl ratchet arm 88 is disengaged by pulling the pawl knob 94 away from the main housing 54. The pawl ratchet arm 88 is approzimately three-fourths inches long by one-eight inch in diameter. The spring retainer 86 is attached to the ratchet pawl shaft approximately three-sixteenths from the shaft end. FIG. 14 further shows the ratchet pawl shaft extending through the main housing body 52 and entering the hollow core of the pawl pull knob 94 through the knob opening 96. The pawl pull knob 94 is approximately nine-sixteenths inches in diameter on the large end, approximately three-eights inches in diameter on the small end, the hole 96 is approximately one eight inch in diameter. FIG. 14 further shows the cavity 93 in the pawl pull knob 94 which is approximately one-fourth inch in diameter by one fourth inch in length. FIG. 14 further shows the snap knob retainer 92 which is approximately three-sixteenths inches in diameter on the large end, approximately three-sixteenths long, and approximately one-eight inch in diameter on the small end. FIG. 14 further shows the ratchet pawl pull knob 94 in place, with the pawl pull knob body 94 enclosing the snap knob retainer 93, thereby, attaching the said knob 94 to the ratchet pawl shaft 88. FIG. 14 further shows the snap knob retainer 93 attached three-thirty-seconds inches from the outside end of the ratchet pawl shaft 88.

Figure 15:
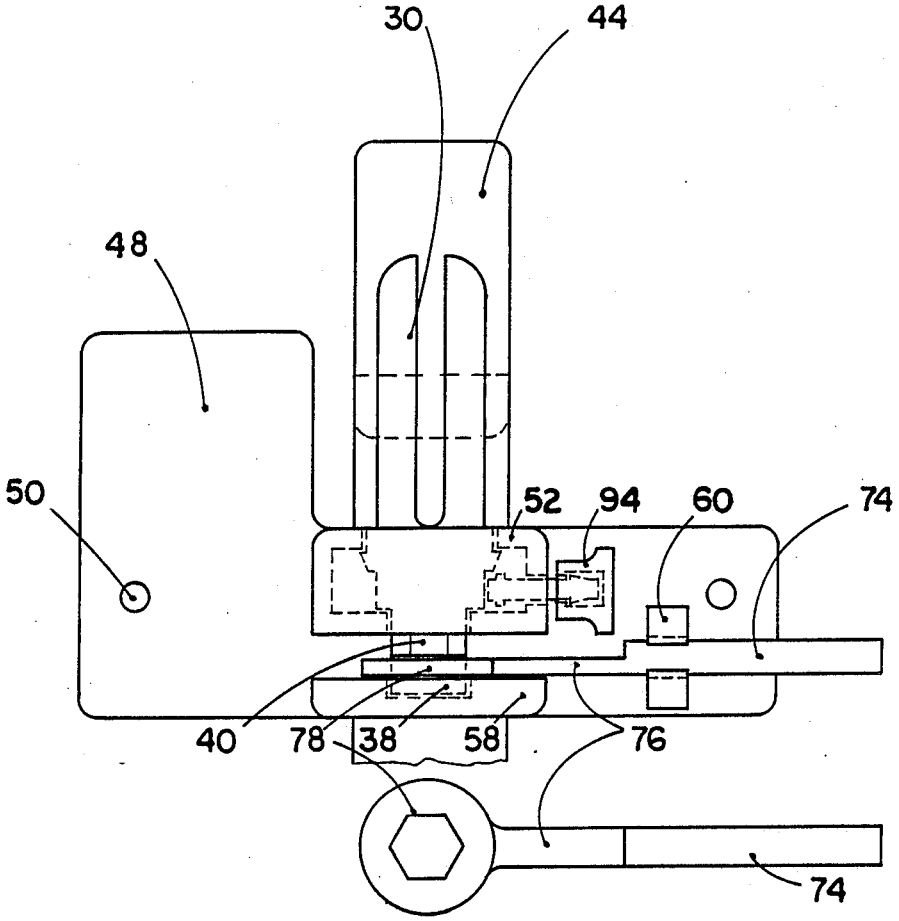
FIG. 15 is a prespective front view of the present invention showing the hexagon wrench and hexagon nut replaceing the ratchet arm and main ratchet wheel of the present invention.

FIG. 15 shows another embodiment or another method of rotating the split or divided accumulator 30. A hexagon nut 40 with each side of the nut measuring approximately one-fourth inch in length, and replaces the main ratchet wheel 36 in FIG. 12. FIG. 15 further shows a hexagon wrench 74 which is used to rotate the hexagon nut 40. The said wrench 74 has a rounded handle portion approximately one and five-eights inches in length by approximately one fourth inch in diameter and a flat handle portion being approximately seven-eights inches in length and having one half the diameter of the round handle portion. The flat handle portion is formed into the wrench head section which is approximately seven-eights inches diameter by one-eight inch in thickness and contains a hexagon opening measuring approximately one fourth inch on each side.

FIG. 16 shows another embodiment and method of rotating the split or divided accumulator 30. FIG. 16 further shows the main housing constructed of two parts, the top housing 98 and the bottom housing 99.

FIG. 17 shows a top prespective view of FIG. 16 with the ratchet wheel 104 being approximately one and seven-eights inches in diameter and having twelve equal and identical teeth. FIG. 17 further shows a worm gear 102 which is approximately one inch in lenght, five-eights inches in diameter, and is capable of rotating the ratchet wheel both forwards and backwards, and is capable of holding the ratchet wheel in a stationary position. FIG. 17 further shows the worm gear 102 as a formed or cast part of the shaft 111 which is approximately three and one-half inches in length and is approximately three-eights inches in diameter. FIG. 17 further shows bushings 103 and 105 as being formed or cast parts of the shaft 111, bushing 103 is approximately five-eights inches in diameter and approximately three-sixteenths inches thick and is formed into the shaft 111 approximately three-eights inches from the end which will fit into support block 109. FIG. 17 further shows shaft support end block 109 being approximately one inch wide by approximately three-eights inches thick and approximately one and one-half inches from top to bottom. Said block is split in two, with the top portion being approximately one inch from top to bottom and with a half hole in the center bottom having a radius measuring approximately three-sixteenths inches. Said block is formed or cast into the left rear corner of the top section 98. Said blocks bottom section measures approximately one-half inch from bottom to top, has a center top half hole with a radius of approximately three-sixteenths and is formed or cast into the lower left rear corner of the bottom housing 99. The two parts of the end block 109, when placed togeather, surround and enclose the back end of the shaft 111. The hole created when the end blocks are placed togeather measures approximately three-eights inches in diameter and is approximately three-eights inches deep. FIG. 17 further shows shaft support end block 107 being approximately one inch wide, three-sixteenths inches thick, and approximately one and one half inches from top to bottom. Said block is split into two parts, the top portion being approximately one inch from top to bottom and with a half hole in the center bottom having a radius measuring approximately three-sixteenths inches. Said block is formed or cast into the left front corner of the top section 98. Said block has a bottom section part which measures approximately one-half inch from bottom to top and has a center top half hole with a radius of approximately three-sixteenths inches and said block part is formed or cast into the lower left front corner of the bottom housing 99. When the upper housing 98 containing the top block portion is fitted together with lower housing 99 containing bottom block portion, thereby, joining the block portions togeather and creating a hole which measures approximately three eights inches in diameter and three-eights inches deep which encloses and supports the front end of shaft 111. FIG. 17 further shows bushing 105 formed or cast into shaft 111 approximately three-fourths inches from the front end of shaft 111 and will rest against the back portion of the support block 107, thereby preventing forward movement of the shaft 111. FIG. 17 further shows the shaft 111 extending through the hole 113 in the lower left corner of the lower housing 99. The hole 113 is approximately three-eights inches in diameter and is located on center, approximately five-eights inches up from the bottom of the bottom housing 99 and approximately three-fourths inches in from the lower left side of the bottom housing 99.

FIG. 18 further shows bushing 105 being approximately five-eights inches in diameter and approximately three-six-teenths inches thick and formed or cast into shaft 111. FIG. 17 further shows a flat key 100 used to rotate shaft 111 being approximately three-sixteenths inches thick and having two legs of the u-shaped portion each measuring approximately three-eights inches by three-eights inches and being attached to a common or base section or top of the u portion measuring approximately one-half inch deep by five-eights inches wide. The oppisite ends of each leg is attached to a round portion measuring approximately one half inch in length and five-sixteenths inches in diameter with a center hole measuring approximately three-sixteenths inches in diameter, these holes being 115 and **115*a* respectively. FIG. 17 further shows the shaft 111 having a hole 117 approximately one-eight inch from the front end of the shaft measuring approximately three-sixteenths inches in diameter, through shaft center. FIG. 17 further shows a securing pin 106 being approximately three-sixteenths inches in diameter and two and one fourth inches in length with enlarged ends being approximately one fourth inch in diameter. Said pin 106 passes through holes 115, 115*a*, and 117, thereby securing the key 100 to the shaft 111**.

FIG. 18 shows a prespective side view of FIG. 16. FIG. 18 further shows a shoulder bushing 119 measuring approximately one and five-eights inches inches in diameter and approximately seven-sixteenths inches thick and attached to the split or divided accumulator 30 base, and further attached to the ratchet wheel 104 which is approximately three-fourths inches thick and is further attached to the bottom end shaft 120 which is approximately one and five-eights inches in diameter and approximately five-sixteenths inches thick and penetrates the bottom housing 99 by a depth of one-sixteenth inch.

FIG. 18 further shows the attachment strap holder 46 attached to the plastic liner securing apparatus at the top center portion of housing part 98. In this embodiment the said strap holder is comprised of two parts, each approximately nine sixteenths inches wide, one eight inch thick, and one inch from top to bottom. FIG. 17 shows the attachment strap holder 46 as the two parts extend outward from the back of the housing portion 98, wrap around and curve in slightly at their ends, thereby, forming a cavity or opening which allows for the insertion of the attachment support strap 44.

Figure 19:
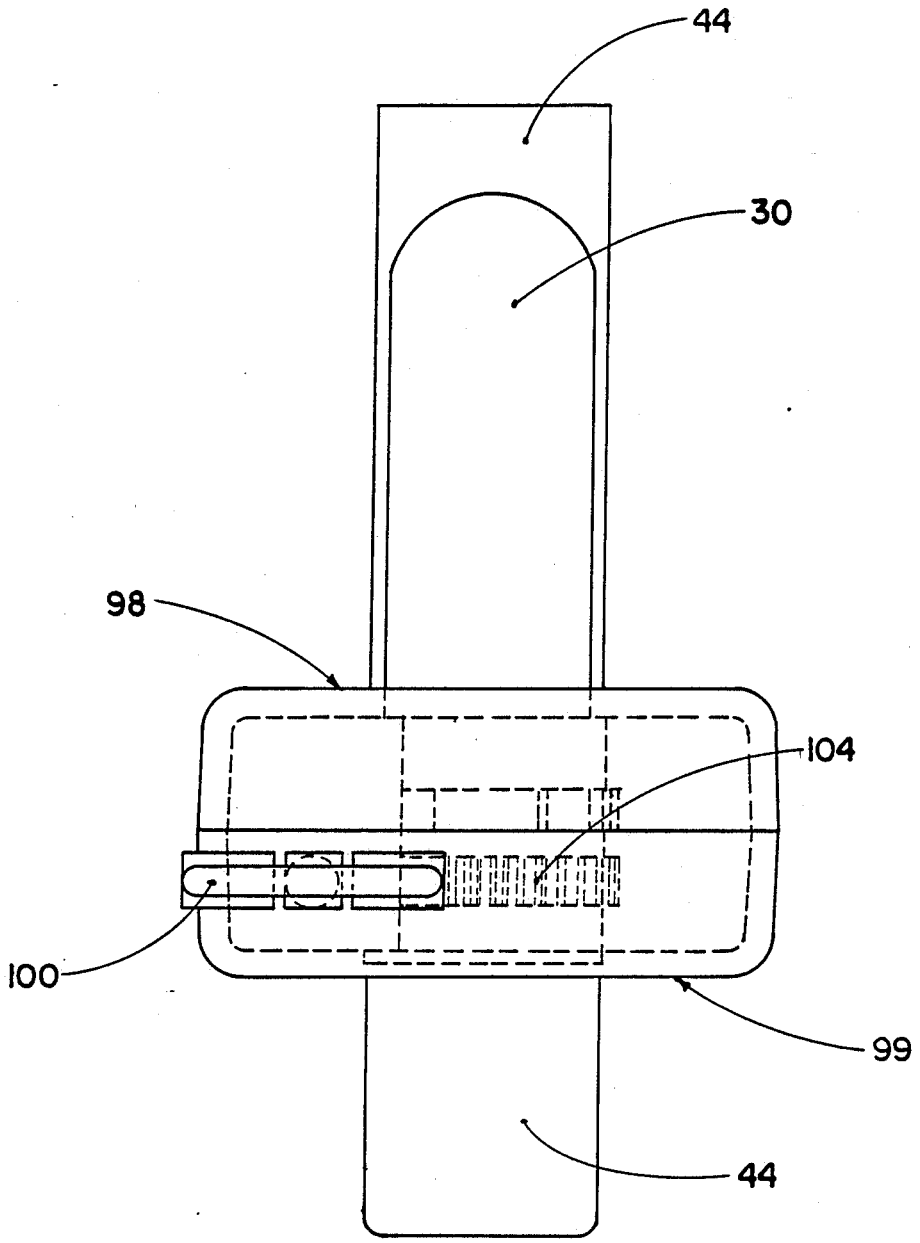
FIG. 19 is a prespective front view of FIG. 16.

FIG. 19 shows a prespective front view of FIG. 16.

Figure 20:
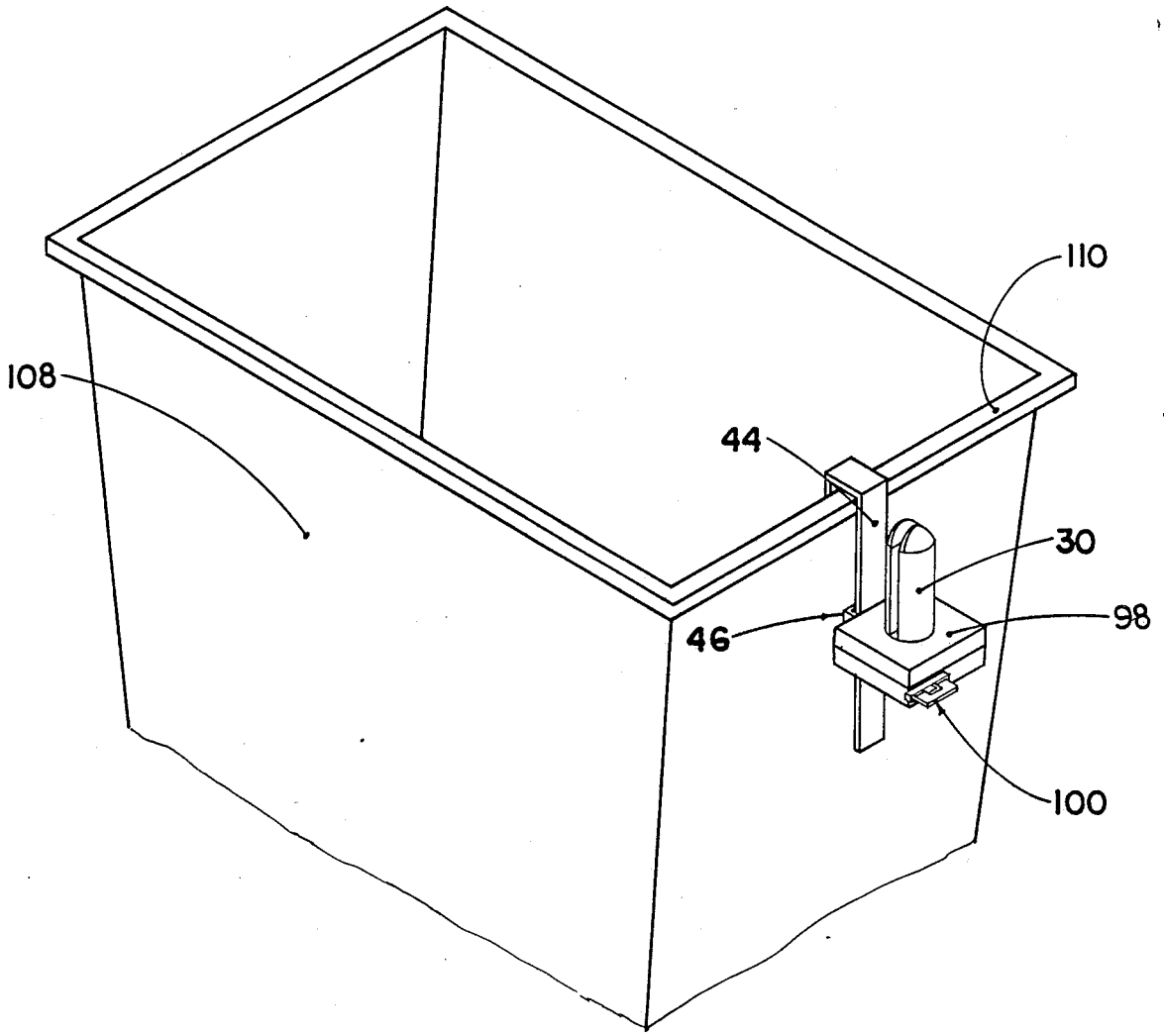
FIG. 20 is a perspective view of FIG. 16 attached to a waste or storage container.

FIG. 20 shows a prespective of FIG. 16 attached to the waste or storage container 108.

Figure 21:
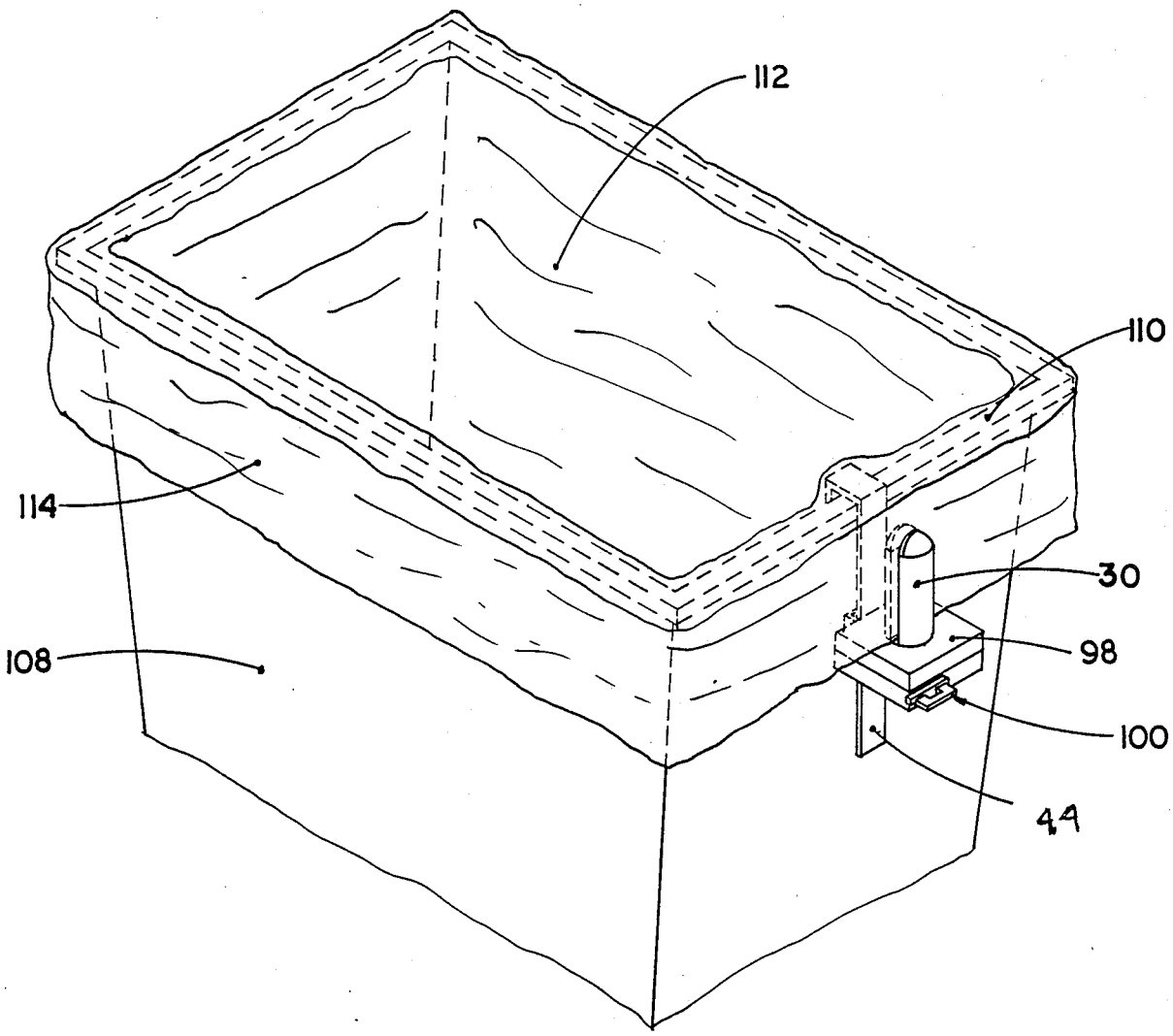
FIG. 21 is a perspective view of FIG. 16 showing a plastic liner placed within, folded over, and inserted into the split or divided shaft of FIG. 16.

FIG. 21 shows the plastic liner securing apparatus attached to the waste or storage container 108 of FIG. 16 and with the flexible plastic liner portion 114 inserted within the split or divided accumulator 30.

Figure 22:
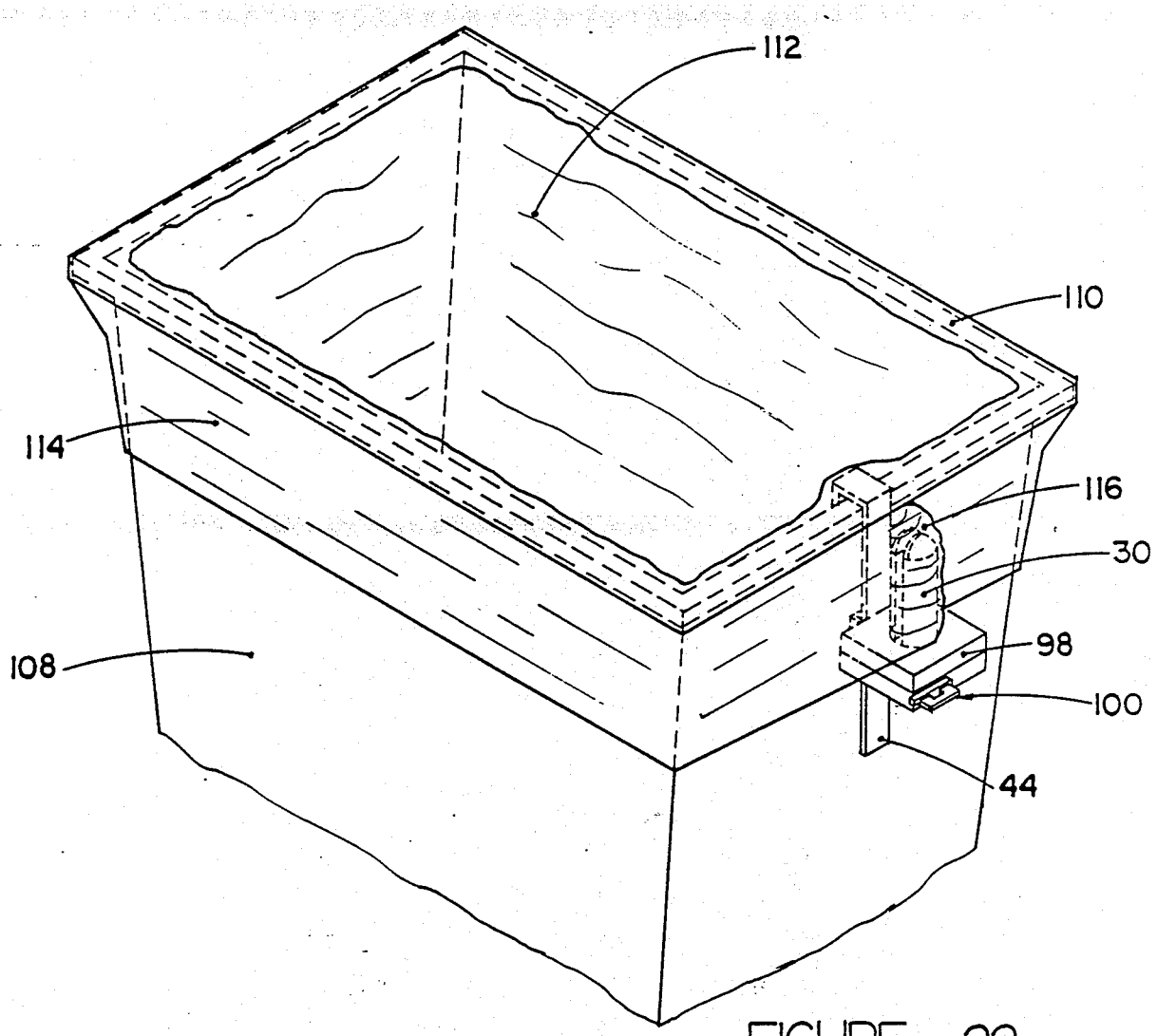
FIG. 22 is a perspective view of FIG. 16 showing the top of the overlapped liner being tightened around the top of the waste or storage container.

FIG. 22 shows the split or divided accumulator 30 accumalating the plastic liner portion 114 around the said shaft, thereby, tighting the liner portion 114 around the top uppermost portion of the container 108. FIG. 22 further shows the accumalated plastic liner mass 116 between the attachment support strap 44 and the split or divided accumulator 30.

FIG. 23 is another embodiment of the plastic liner securing apparatus, showing a wire or plastic attachment hanger 159 which is used to attach the apparatus to the container 108. Said hanger is constructed of a wire or plastic material being approximately 22 inches in length and three sixteenths in diameter. The two ends of the hanger 159 which are fitted into the mounting bracket holes 148 are spaced apart approximately three and three fourths inches and are perpendicular to the top surface of the mounting bracket portion of the main housing 154. With the two ends parallel the material is formed into a u shape and 90 degree bends are made approximately three inches from the ends and the material is bent toward the front of the hanger. A second set of 90 degree bends are made approximately three fourths inches from the first bends and the material is bent upward with the upward pieces being parallel to the first three inch pieces created. A third set of 90 degree bends are made with the two pieces formed being approximately one and one fourth inches in length and these pieces should point toward the back of the hanger and should be parallel to each other and parallel to the top of the mounting bracket of the main housing 154. A fourth set of 90 degree bends are made which should form pieces of material which are approximately one inch in length and should turn the remaining portion of the u shaped material down toward the starting ends of the material. The base piece of the u shaped material should measure approximately four and one half inches and the leg portions should measure approximately four inches each. The leg portions will be slightly angled which helps to counter act the torque created by split or divided accumulator when the plastic liner is being tightened around the container 108.

Figure 24:
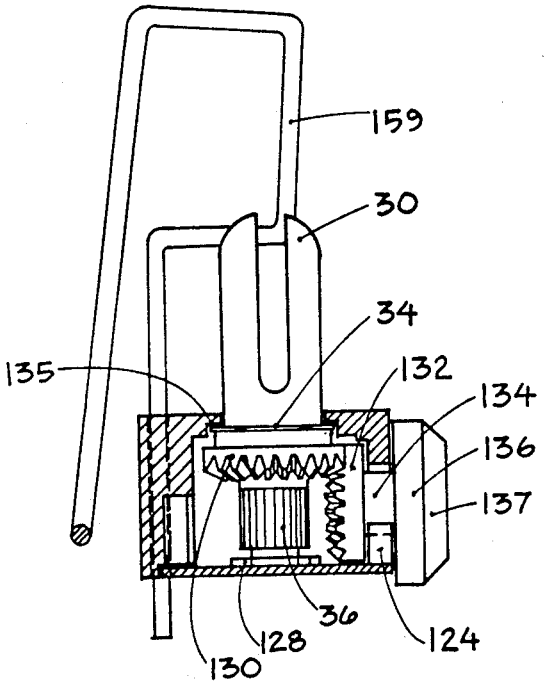
FIG. 24 is a sectional side view of FIG. 23.

FIG. 24 shows a sectional side view of the pawl ratchet wheel or gear which in this embodiment is approximately one half inch in diameter and approximately one half inch in lenght and has approximately ten equal and identical teeth.

FIG. 24 further shows the main beveled gear 130 which is approximately one and one-sixteenth inch in diameter and has approximately 20 equal and identical teeth, is approximately one fourth inch thick, and is attached to the shaft spacer and retainer 34 which is attached to the split or divided accumulator 30. FIG. 24 further shows the recessed portion 135 which is approximately three thirty seconds inches deep and fifteen sixteenths in diameter and receives the shaft spacer and retainer 34. FIG. 24 further shows the raised portion 128 which is approximately five-eights inches in diameter and three thirty-seconds inches deep on the outside and the recessed portion 126 which is approximately five sixteenths inches in diameter and three thirty-seconds inches deep on the inside and is an integral part of the bottom securing plate 121. The part 128 supports, contains, and encloses the shaft end 38 which in this embodiment is approximately five-sixteenths inches in diameter and approximately three-thirty seconds inches in length. FIG. 24 further shows the shaft support 124 as an integral part of the bottom securing plate 121. The support is approximately one half inch wide, three-eights inches high, and one-fourth inch thick and is curved to fit and support the bottom portion of the shaft 134. FIG. 24 further shows the beveled drive gear 132 as being approximately seven-eights inches in diameter and approximately one-fourth inch thick and has approximately fifteen equal and identical teeth and is connected to the shaft 134 which is approximately one half inch in diameter and approximately one fourth inch in length and is further connected to the twist knob 136 which is approximately one and one fourth inches in diameter and approximately three sixteenths thick and has a raised portion 137 on the knob center face which is approximately one inch in length, three-sixteenths inches wide and three-sixteenths inches deep. FIG. 24 further shows hanger 159 as inserted through holes 148 in the mounting bracket of the housing 154.

FIG. 25 shows a top sectional view of the plastic liner securing apparatus which shows the pawl release or push button 140, the mounting bracket holes 148 which receive the hanger 159. FIG. 25 further shows the gear engageing portion 138 of the pawl as it engages the pawl ratchet wheel or gear 36. FIG. 25 further shows the recessed portions 162 and 163 which measure approximately three eights inches top to bottom, one eight inch deep and one fourth inch front to back and are so recessed as to accommodate the nuts that secures the bolts which pass through the container side and through the horizontal holes 50 in the mounting bracket portion of the housing. FIG. 25 further shows a recessed portion 160 which is approximately one inch from front to back, five eights inches top to bottom, 0 inches on the front portion and approximately three eights inches deep on the back portion. FIG. 25 further shows the pawl end 144 as inserted into the housing body 154. FIG. 25 further shows the pawl ratchet wheel or gear 36 and extends through hole 161 which measures approximately one fourth inch in diameter and is centered approximately three fourths inches back from the housing face 155 and equidistant from the sides of the recessed portion 160. FIG. 25 further shows the cavity 146 in the housing 154 which is approximately one and nine sixteenths inches from front to back and is curved on both the front and back ends, the two sides measure approximately one and one eight inches respectively, the measurements start one fourth inch back from the outside surface of face portion 155. The front arc or curve should be formed so as to act as a bearing surface for the back of the beveled drive gear 132 and hold the gear 132 in position to engage the main beveled gear 130. FIG. 25 further shows the cavity is approximately one and one eight inches wide and approximately fifteen-sixteenths inches as measured from bottom to top and is recessed one-sixteenth inch to receive the bottom securing plate 121.

Figure 26:
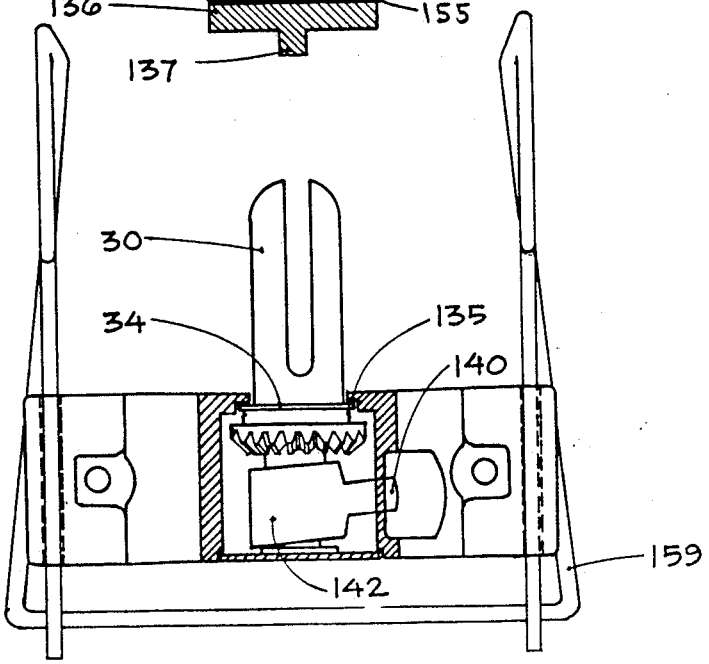
FIG. 26 is a sectional front view of FIG. 23.

FIG. 26 shows a sectional front view of the plastic liner securing apparatus.

FIG. 27 shows a prespective view of the hanger 159.

FIG. 28 shows a prespective view of the portion in the present embodiment termed housing portion 154. FIG. 28 further shows the hole 54 in the top portion of the housing 154, the hole measuring approximately seven-eights inches in diameter. FIG. 28 further shows the mounting bracket end portion 156 which is approximately one and one fourth inches top to bottom and approximately five sixteenths inches from front to back. FIG. 28 further shows the mounting bracket portion of the housing 154 is approximately four inches wide and approximately one and one fourth inches from top to bottom. FIG. 28 further shows the recessed portion 152 which fits over shaft 134 and measures, approximately one half inch in width, approximately five eights inches from bottom to top and is curved at the top to fit over the shaft 134 and the curved portion has the same radius as shaft 134, the thickness of the housing around this recessed portion is approximately one eight inch thick, outside to inside. FIG. 28 further shows the front portion 155 of the housing 154 which measures approximately one and one fourth inches from top to bottom and one and five sixteenths inches wide. FIG. 28 further shows the raised portions 158 and 164 which contain the horizontal mounting holes 50, the raised portions measure approximately three eights inches wide, three eights inches high, and three eights inches deep, front to back. The raised portions are slightly curved at the points where they are attached to the housing portion 154. FIG. 28 further shows that sides 153A and 153B of the housing 154 measure approximately one and five sixteenths inches from front to back and approximately one and one fourth inches from top to bottom. FIG. 28 further shows that sides 153C and 153D measure approximately three eights inches in length and are approximately one and one fourth inches from top to bottom and that the housing portion between sides 153C and 153D measures approximately two and one half inches in width.

FIG. 29 shows a prespective view of the bottom securing plate 121 showing the four welding holes all numbered 122 which are approximately one eight inch in diameter and are located approximately one sixteenths inches in from each side of each corner and are used to ultrasonically weld the plate to the bottom of housing 154. The bottom securing plate measures approximately one and one fourth inch in width and approximately one and three fourths inches from front to back and is positioned on center with the front edge of the plate being even with the front edge of the housing face 155.

FIG. 30 shows the pawl 142 with push button end 140 which measures approximately three eights inches in length and one fourth inch in diameter and is an integral part of pawl 142. FIG. 30 further shows the pawl 142 is an L shaped piece with the push button end of the L piece measuring approximately three fourths inches in length, nine sixteenths inches in width and three thirty seconds inches in thickness. FIG. 30 further shows the enlarged end portion 144 of the pawl 142 which measures approximately one eight inch in diameter and is inserted into a one eight inch diameter hole which is located on center approximately one fourth inch left of a center line passing through the center of the pawl ratchet wheel or gear 36 in the back portion of the housing 154. The one eight inch hole is left open in front to accommodate the pawl body portion. FIG. 30 further shows the L pawl side with the enlarged end portion measures approximately one and one eight inch in length and nine sixteenths inches in width. FIG. 30 further shows the pawl 142 with the gear engageing portion 138 which is approximately one sixteenth inch high and is curved on each side from top to the base and when engageed is capable of preventing counter-rotation of the split or divided accumulator under normal conditions. The gear engageing portion 138 of the pawl is located on the long side of the L portion of the pawl and is centered on the center of the pawl ratchet wheel or gear.

FIG. 31 is a prespective view of the split or divided accumulator 30 which in this embodiment is approximently seven eights inches in diameter and is approximately one and one half inches in length, has two vertical portions which are spaced apart approximately three sixteenths inches and are approximately one and one fourth inches in length and are joined togeather at their bases to form a common base which is approximately seven eights inches in diameter and approximately one fourth inch thick. FIG. 31 further shows the main beveled gear 130 which is approximately one fourth inch thick, the pawl ratchet wheel or gear 36 which in this embodiment is approximately one half inch top to bottom, approximately one half inch in diameter and has approximately ten equal and identical teeth, the shaft spacer and retainer 34, which in this embodiment is approximately three thirty seconds inches thick and approximately fifteen sixteenths inches in diameter, and the shaft end 38 which in this embodiment is approximately five sixteenths inches in diameter and approximately three thirty seconds inches high or thick.

FIG. 32 shows a prespective view of the twist knob 136, the shaft 134, and the beveled drive gear 132.

Figure 33:
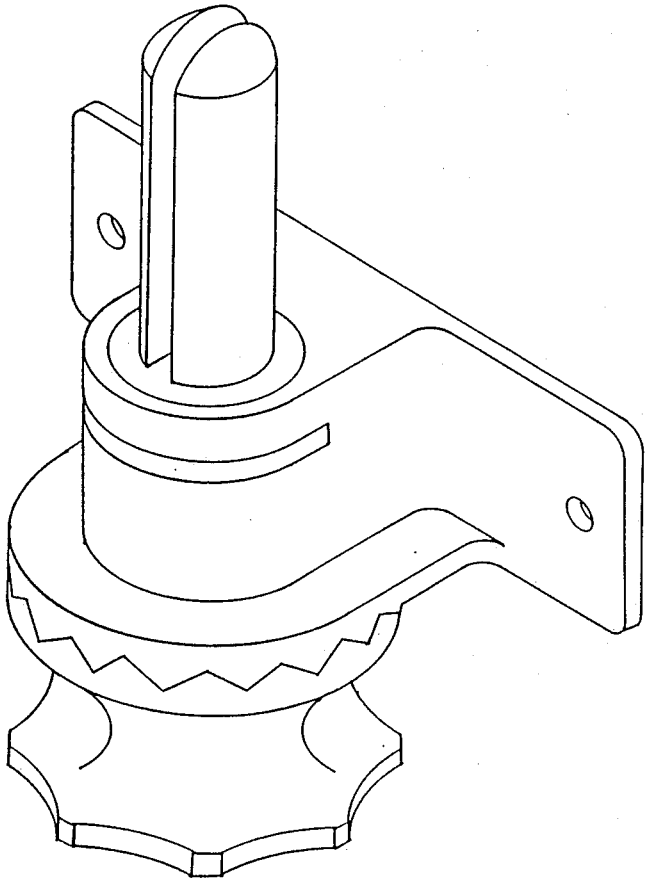
FIG. 33 is another embodiment of the plastic liner securing apparatus.

FIG. 33 is another embodiment of the plastic liner securing apparatus, showing an isometric projection.

Figure 34:
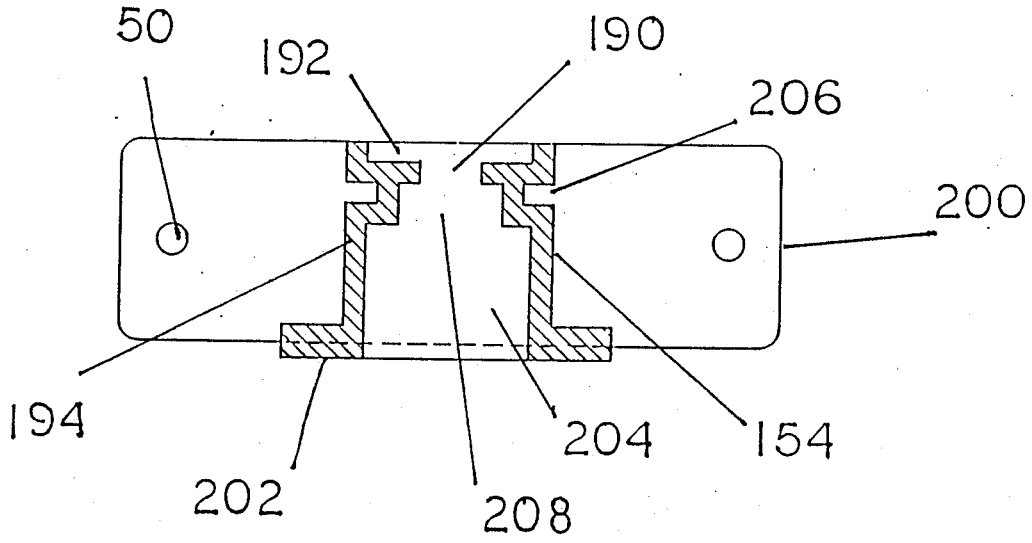
FIG. 34 is a sectional view of the main housing portion.
Figure 39:
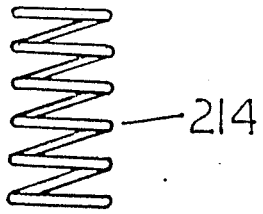
FIG. 39 is a perspective view of the compression spring.

FIG. 34 is sectional view of the main housing portion 154 showing the recess portion 192 which measures approximately one inch in diameter and is approximately one eight inch in depth and receives the split or divided accumulator base 169 of FIG. 39.

FIG. 34 further shows a hole or further recess in the center of the recess portion 192, numbered 190 which measures approximately three eights inches in diameter and is approximately one eight inch from top to bottom or in depth.

FIG. 34 further shows a recess portion 206 which goes completely around the housing portion 154 and measures approximately one eight inch in depth.

Figure 38:
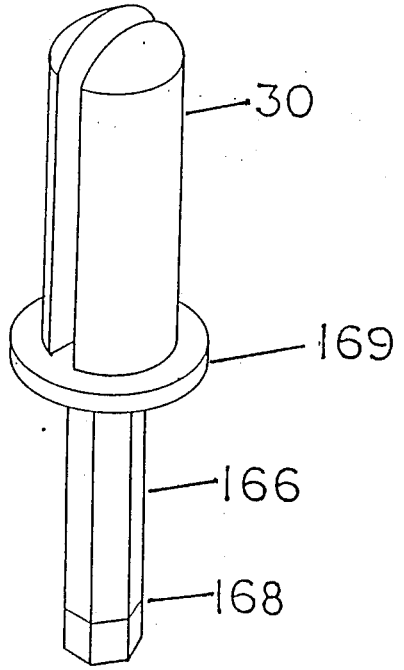
FIG. 38 is a perspective view of the accumulator.

FIG. 34 further shows recess portion 208 which measures approximately nine sixteenths inches in diameter and approximately one fourth inch from top to bottom and receives the portion 174 of FIG. 38.

FIG. 34 further shows the recess portion 204 which measures approximately fifteen sixteenths inches in diameter and is approximately seven eights inches from top to bottom and which receives the portion 175 of the twist knob assembly in FIG. 38.

FIG. 34 further shows a sectional view of the engaging plate 202 which measures approximately two inches in diameter and is approximately one fourth inch from top to bottom and contains approximately twenty four teeth which measure approximately one eight inch from crest to root on the vertical measurement.

FIG. 34 further shows the portion 194 of the housing 154 measuring approximately one and one fourth inches from the top of the engaging plate to the top of the housing and approximately one and one fourth inches from side to side.

FIG. 34 further shows a mounting bracket portion which in this embodiment is numbered 200 and is approximately one and one fourth inches from top to bottom and approximately four inches in width.

FIG. 34 further shows two holes, both numbered 50, which measure approximately three sixteenths inches in diameter and are located on center approximately one fourth inch in from either end of the portion 200.

Figure 35:
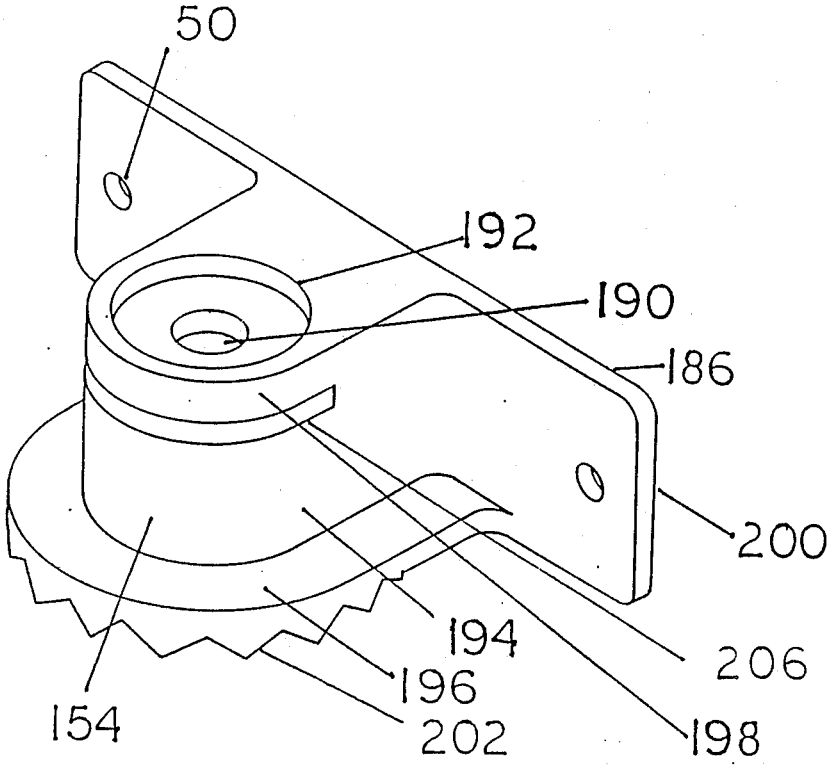
FIG. 35 is a perspective view of the main housing portion.

FIG. 35 is an isometric projection of FIG. 35 showing the top portion 196 of the engaging plate 202 as being formed or molded into the mounting plate 200 at a point approximately one inch in from either end of the said plate.

FIG. 35 further shows recess portion 190 as being approximately three eights inches in diameter and that it measures approximately one inch from the center of the recess 190 to the front edge of the engaging plate 202 and that it measures approximately one and one half inches from the center of the recess 190 to the back of the mounting bracket plate portion 186 of the mounting bracket 200.

Figure 36:
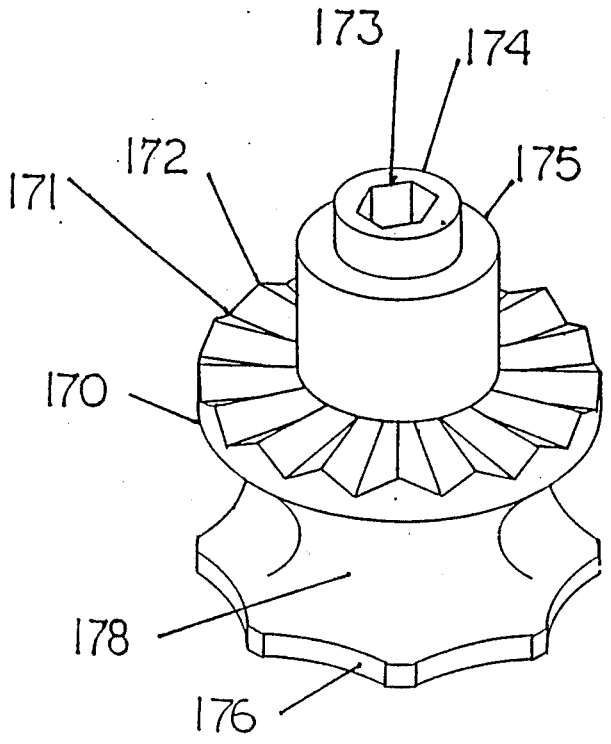
FIG. 36 is a perspective view of the twist knob assembly.

FIG. 36 shows an isometric projection of the twist knob assembly showing approximately twenty four teeth on the twist knob engaging plate 170 which measures approximately two inches in diameter and is approximately one fourth inch thick or approximately one fourth inch from top to bottom.

FIG. 36 further shows portion 175 which measures approximately three fourth inch in height and approximately one inch in diameter and fits into recess 204 of FIG. 34.

FIG. 36 further shows portion 174 which measures approximately nine sixteenths inches in diameter and is approximately one fourth inch in height and fits into recess portion 208 of FIG. 34.

FIG. 36 further shows a hexagon shaped hole 173 through the center of portion 174 which measures approximately three eights inches from vertex to vertex of opposite or opposing angles of the hexagon.

FIG. 36 further shows the twist knob portion 176 which is approximately two inches in diameter with approximately eight finger recesses which measure approximately one half inch and whose maximum curvature is approximately one sixteenth inch.

FIG. 36 further shows portion 178 of the twist knob assembly which measures approximately seven eights inches from the top of the twist knob portion 176 to the bottom of the engagement plate 170 and with the curved portion of portion 178 being formed so that a horizontal line passing through the center of portion 178 would measure approximately one inch when measured from side to side at the center.

Figure 37:
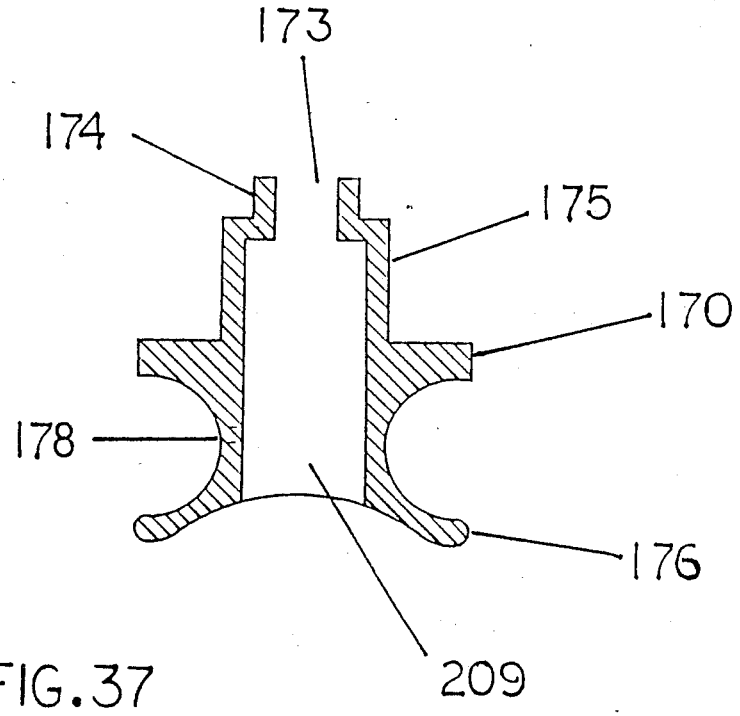
FIG. 37 is a sectional view of the twist knob assembly.

FIG. 37 shows a sectional view of the twist knob assembly.

FIG. 37 further shows recess portion 173 through which the shaft portion 166 of FIG. 38 passes.

FIG. 37 further shows portion 173 as being the portion which fits over shaft 166 allowing the twist knob assembly to rotate the accumulator when the twist knob is rotated.

FIG. 37 further shows recess portion 209 which measures approximately three fourths inches in diameter and is approximately one and five eights inches in height or from top to bottom and holds or contains the spring 214 of FIG. 39.

FIG. 38 shows the accumulator 30, accumulator base 169, shaft 166, and slot in shaft 168.

FIG. 38 further shows the accumulator in this embodiment as measuring approximately one and one half inches in height or from the top of base 169 to the top of the accumulator and measuring approximately three fourths inches in diameter.

FIG. 38 further shows the accumulator 30 is composed of two equal parts and separated by a one eight inches space which completely divides the two portions from top to base.

FIG. 38 further shows shaft 166 as being a hexagon shaped shaft measuring approximately two and one eight inches in length and measuring approximately three eights inches across or between the vertexs of the opposite or opposing angles of the hexagon base.

Figure 41:
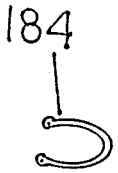
FIG. 41 is a perspective view of the snap ring retainer.

FIG. 38 further shows a slot 168 which measures approximately one sixty fourth inch in width and one sixty fourth inch in depth and which completely circumscribes the hexagon shaft at a point approximately one eight inch from the lower or open shaft end and into which the snap retainer 184 of FIG. 41 fits.

FIG. 39 shows a compression spring 214 which is approximately five eights inches in overall width and approximately one and one fourth inches in overall length and has the necessary strength to hold the engaging gear teeth of the engaging plates 170 and 202 in and engaged position under normal load pressure.

NOTE: The engaging teeth on the engaging plates 170 and 202 may be any standard or modified standard gear tooth design, such as but not limited to, sharp V with rounded crest and root, modified buttress with rounded crest and root or a knuckle type.

Figure 40:
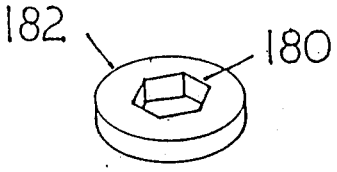
FIG. 40 is a perspective view of the shaft bushing.

FIG. 40 shows a shaft bushing 182 which is approximately three fourths inches in diameter and which has a hexagon opening which measures approximately three eights inches from vertex to vertex of the opposite or opposing angles of the hexagon.

FIG. 40 further shows the bushing 182 is approximately three sixteenths inches thick and fits over the shaft 166 of FIG. 38 and holds the spring 214 of FIG. 39 in the recess 209 of FIG. 37.

FIG. 41 shows the snap ring retainer which fits into slot 168 on shaft 166 of FIG. 38 and is sufficiently large to keep or hold the bushing 182 of FIG. 40 on the shaft 166 of FIG. 38 under normal load or operating pressures.

Figure 42:
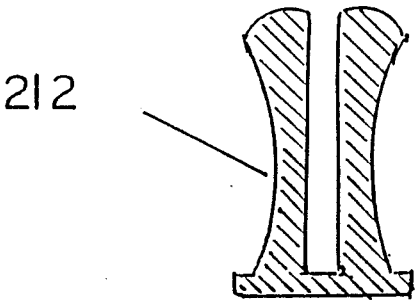
FIG. 42 is a sectional view of an accumulator.

FIG. 42 shows a sectional projection of the accumulator indicating that the outside portion 213 of the accumulator may be curved inward from top to base.

Figure 43:
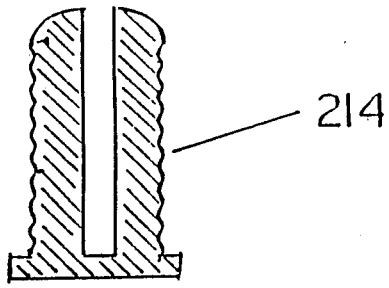
FIG. 43 is a sectional view of an alternative accumulator.

FIG. 43 shows a sectional projection of the accumulator indicating that the outside portion 214 of the accumulator be ridged to provide greater holding for the liner material.

Figure 44:
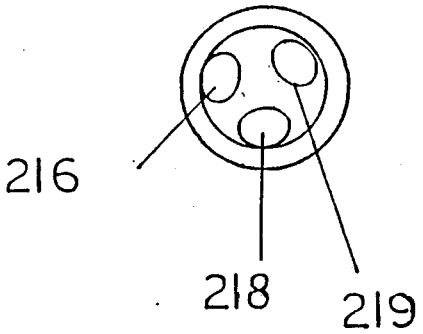
FIG. 44 is a top view of an accumulator.

FIG. 44 shows a top view of the accumulator indicating that there can be two or more vertical portions on the accumulator, such as portions 216, 218 and 219.

Figure 45:
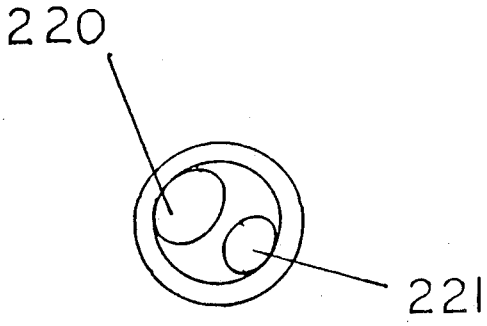
FIG. 45 is a top view of an alternative accumulator.

FIG. 45 shows a top view of the accumulator indicating that the vertical portions of the accumulator may be unequal in size and shape, with portion 220 being larger and of a different shape than portion 221.

NOTE: The mounting bracket 48 of FIG. 14 may be attached to the container 108 of FIG. 1 by utilizing adhesive attachment means covered by a peelable protective strip or strips. The adhesive is factory applied to the back side of the mounting bracket 48 and is covered by a peelable covering which can be easily removed, thereby, allowing the mounting bracket 48 to be attached to the waste or storage container approximately two inches below its rim or edge 110 on the exterior side of the container 108.

It is obvious that there are many other modifications of the securing device which are possible. Thus any means for securing or obtaining the same effect of securing or attaching flexible plastic liners to, and holding said liners within, rigid or semi-rigid waste or storage containers, which are within the scope of the following claims and their legal equilvalents should be considered to be part of the present invention.

I claim:

1. For rigid or semi-rigid waste or storage containers which utilize flexible plastic liners, a plastic liner securing apparatus or device for securing or attaching flexible plastic liners to and holding said liners within said containers by inserting the folded over or turned down portion of the liner top directly into the open split or divided accumulator and rotating the accumulator until the liner is tightened or stretched around the top uppermost portion of the container, said apparatus comprising:

(a) a split or divided accumulator means having two or more elongated vertical portions being spaced apart and being joined together at their bases to form a common base or single base portion (b) a rotational transmission means which is capable of rotating the split or divided accumulator (c) a holding releasing means which is capable of holding the split or divided accumulator in a stationary position for indefinite periods and allowing the split or divided accumulator to be counter rotated (d) a housing means which supports the split or divided accumulator and houses, supports, or contains, the rotational transmission means, and the holding releasing means (e) said housing means is attached to or is an integral part of a mounting bracket means which is used to attach the apparatus or device to the waste or storage container.

2. The attachment of the mounting bracket means in claim 1 to the waste or storage containers 1 wherein adhesive strips are attached to the mounting bracket means and covered by protective peelable strips which are removed prior to attaching the mounting bracket means to the waste or storage container.

3. The attachment of the mounting bracket means in claim 1 to the waste or storage containers in wherein one or more u shaped straps which have one end of the u shaped portion attached to the apparatus and the other end hooked over the edge or rim of the waste or storage containers.

4. The attachment of the mounting bracket means in claim 1 to the waste or storage containers wherein one or more necessary holes in the mounting bracket means aline with like necessary holes in the waste or storage container and through which bolts or plastic fastners may be inserted thereby attaching the mounting bracket means to the waste or storage container.

5. The attachment of the mounting bracket means in claim 1 to the waste or storage container wherein the mounting bracket means is manufactured as an integral part of the waste or storage container.

6. The attachment of the mounting bracket means in claim 1 to the waste or storage container wherein a necessary hole or cavity in the mounting bracket means fits over a protruding part manufactured into the outside surface of the waste or storage container.

7. The attachment of the mounting bracket means in claim 1 wherein a u shaped hanger has ends extending through the mounting bracket means and the u shaped portion hooked over the waste or storage container edge.

* * * * *